US010769887B2

(12) United States Patent
Soukup et al.

(10) Patent No.: US 10,769,887 B2
(45) Date of Patent: Sep. 8, 2020

(54) CASINO MANAGEMENT SYSTEM WITH ANONYMOUS PLAYER BONUSING

(71) Applicant: Konami Gaming, Inc., Las Vegas, NV (US)

(72) Inventors: Thomas E. Soukup, Las Vegas, NV (US); Edward Sepich, Henderson, NV (US); Jeffrey George, Las Vegas, NV (US); Jason Bertsch, Las Vegas, NV (US)

(73) Assignee: Konami Gaming, Inc., Las Vegas, NV (US)

( * ) Notice: Subject to any disclaimer, the term of this patent is extended or adjusted under 35 U.S.C. 154(b) by 4 days.

(21) Appl. No.: 16/194,692

(22) Filed: Nov. 19, 2018

(65) Prior Publication Data

US 2019/0164384 A1 May 30, 2019

Related U.S. Application Data

(60) Provisional application No. 62/590,980, filed on Nov. 27, 2017.

(51) Int. Cl.
*G07F 17/32* (2006.01)

(52) U.S. Cl.
CPC ..... *G07F 17/3255* (2013.01); *G07F 17/323* (2013.01); *G07F 17/3206* (2013.01); (Continued)

(58) Field of Classification Search
None
See application file for complete search history.

(56) References Cited

U.S. PATENT DOCUMENTS 6,371,852 B1 * 4/2002 Acres ..... G07F 17/32 463/16
9,153,095 B2 10/2015 Adiraju et al.
(Continued)

FOREIGN PATENT DOCUMENTS

| | | |
|---|---|---|
| AU | 757903 | 3/2003 |
| JP | 2014-531956 A | 12/2014 |
| JP | 2014-531957 A | 12/2014 |

OTHER PUBLICATIONS

Examination Report No. 1 (AU Patent Application No. 2018267641); dated Aug. 8, 2019; 5 pages.

*Primary Examiner* — Jason T Yen
(74) *Attorney, Agent, or Firm* — Howard & Howard Attorneys PLLC

(57) ABSTRACT

A gaming system including a casino management server coupled to a plurality of gaming machines is described herein. The casino management server includes a processor programmed to initiate a bonus award feature, identify gaming machines associated with the bonus award feature, and determine a bonus award associated with the bonus award feature. The bonus award includes a first award value associated with a carded player account and a second award value associated with an un-carded anonymous player wagering session and/or account. The processor selects gaming machines having gaming sessions associated with un-carded anonymous players and displays a message notifying the player of the first award value associated with a carded player account and the second award value associated with an un-carded anonymous player. The processor also downloads the second award value to a corresponding gaming credit meter of each selected gaming machine associated with un-carded anonymous players.

17 Claims, 28 Drawing Sheets

(52) U.S. Cl.
CPC ..... *G07F 17/3237* (2013.01); *G07F 17/3239* (2013.01); *G07F 17/3244* (2013.01)

(56) References Cited

U.S. PATENT DOCUMENTS

| | | | | |
|---|---|---|---|---|
| 2002/0128057 | A1* | 9/2002 | Walker | A63F 13/12 463/20 |
| 2005/0124411 | A1* | 6/2005 | Schneider | G06Q 30/0209 463/29 |
| 2008/0026816 | A1* | 1/2008 | Sammon | G07F 17/32 463/20 |
| 2008/0076496 | A1* | 3/2008 | Baerlocher | G07F 17/32 463/1 |
| 2009/0036202 | A1* | 2/2009 | Baerlocher | G07F 17/32 463/25 |
| 2009/0088239 | A1* | 4/2009 | Iddings | G07F 17/3239 463/20 |
| 2009/0117972 | A1* | 5/2009 | Cava | G07F 17/3244 463/20 |
| 2013/0274007 | A1* | 10/2013 | Hilbert | A63F 13/00 463/29 |

* cited by examiner

212

| 180 Player Account | Patron Name | Birthdate | 182 Player Tracking ID | 214 PIN |
|---|---|---|---|---|
| 10001313 | John Smith | 12/16/1965 | 1234567 | 2056 |
| 12001321 | Jane Doe | 01/12/1974 | 7654321 | 8956 |
| 10001365 | Mary Doe | 07/29/1975 | 8521479 | 1234 |

FIG. 9

216

180 Player Acc. #: 10001313

182 Player Tracking ID: 1234567

Address: 1234 Main Street, Anytown

Postal Code: 10234

218

| Session ID | Date | Start | End | Game Type | Total Wagered Amount |
|---|---|---|---|---|---|
| Session001 | 01/16/2016 | 20:32 | 22:05 | Slot | $232.00 |
| Session002 | 01/16/2016 | 22:15 | 23:02 | Slot | $105.00 |

FIG. 10

220

| | Action Record ID (224) | Triggering Event (226) | Action Event Data | Action Event (228) |
|---|---|---|---|---|
| 222 | Action001 | Receive existing player tracking ID | Receive existing player tracking ID and need the corresponding PIN | Request PIN |
| 222 | Action002 | Receive correct corresponding PIN | If correct PIN is received light the NFC reader Green | Light up NFC Reader Green |
| | Action003 | NFC Reader has a Green Light | Find the corresponding player account | Receive Corresponding Player Account |
| | Action004 | Receive existing player tracking ID while patron is using EGM | Allow player tracking ID access to the EGM while a player is using the EGM if the second player ID has a higher priority | Allow second player access to EGM |

FIG. 11

230

226

| 182 Player Tracking ID | 222 Action Record ID | 224 Event Trigger | Action Rule File | Rule Description | Notification Message File | 228 Action Event |
|---|---|---|---|---|---|---|
| 232 1234567 | Action01 | Receive existing player tracking ID | Action01.API | Receive existing player tracking ID and need the corresponding PIN | InfoMessage01 | Request corresponding PIN |
| 232 1234567 | Action02 | Receive correct corresponding PIN | Action02.API | If correct PIN is received light the NFC reader Green | InfoMessage02 | Make NFC Reader Green |
| 1234567 | Action03 | NFC Reader has a Green Light | Action03.API | Find the corresponding player account | InfoMessage03 | Send the corresponding player account information to the player tracking device |
| 7894561 | Action04 | Receive existing player tracking ID while patron is using EGM | Action04.API | Allow player tracking ID access to the EGM while a player is using the EGM if the second player ID has a higher priority | InfoMessage04 | Allow the second player tracking ID access to the EGM |

FIG. 12

212

| 180 Player Account | Patron Name | Birthdate | 182 Player Tracking ID | Tier Level Indicator | Total Wagers | 282 Super Series Numbers | 224 PIN |
|---|---|---|---|---|---|---|---|
| 10001313 | John Smith | 12/16/1965 | 10001399 | Platinum | $20,034 | 05, 06, 08, 14, 15 | 2056 |
| 10001365 | Jane Doe | 01/12/1974 | 10002659 | Gold | $15,678 | 00, 02, 05, 12, 13 | 8956 |
| 10002365 | Mary Doe | 07/29/1975 | 10009953 | Gold | $10,129 | 00, 01, 03, 05, 07 | 1234 |

FIG. 26

250

| 252 Player Account | 254 Gaming Session ID | 256 EGM ID | 258 Total Wagers | 260 Video Image Data |
|---|---|---|---|---|
| 00001 | Session010 | EGM02001 | $20,034 | Image001.jpg |
| 00012 | Session035 | EGM0235 | $15,678 | Image020.jpg |
| 00201 | Session001 | EGM00032 | $10,129 | Image105.jpg |

FIG. 27

262

| | 276 | | 270 | | 272 | |
|---|---|---|---|---|---|---|
| | Advance Incentive | | Carded Patron | | Un-Carded Anonymous Patron | |
| | Incentive Type | Value | Award Type | Award Amount | Award Type | Award Amount |
| 268 | Gaming Session Time | 1.5hr | Non-Cashable EGM Credits | $100 | Cashable EGM Credits | $10 |
| 268 | Gaming Session Average Wager Amount | $20 | Bonus Points | 1,000 | Cashable EGM Credits | $10 |
| | Gaming Session Total Amount Wagered | $250 | Free Play | $88 | Cashable EGM Credits | $20 |

FIG. 28

264

| | | | | 270 | | 272 | |
|---|---|---|---|---|---|---|---|
| | Random Trigger Criteria | | | Carded Patron | | Un-Carded Anonymous Patron | |
| | Gaming Floor Zone | Wager Level | Time | Award Type | Award Amount | Award Type | Award Amount |
| 268 | Slot Machine Zone 1 | $100/hr | 14:00:00 | Non-Cashable EGM Credits | $100 | Cashable EGM Credits | $10 |
| 268 | Slot Machine Zone 1 | $150/hr | 15:00:00 | Bonus Points | 1,000 | Cashable EGM Credits | $10 |
| | Table Game Zone 1 | $20/hr | 18:30:00 | Free Play | $88 | Cashable Table Credits | $20 |

FIG. 29

266

| | Super Series Match | Carded Patron (270) | | Un-Carded Anonymous Patron (272) | |
|---|---|---|---|---|---|
| | Number of Matches | Award Type | Award Amount | Award Type | Award Amount |
| 268 | 1 | Non-Cashable EGM Credits | $100 | Cashable EGM Credits | $10 |
| 268 | 2 | Bonus Points | 1,000 | Cashable EGM Credits | $10 |
| | 3 | Free Play | $88 | Cashable EGM Credits | $10 |
| | 4 | Cashable EGM Credits | $200 | Cashable EGM Credits | $20 |
| | 5 | Cashable EGM Credits | $500 | Cashable EGM Credits | $30 |

FIG. 30

CASINO MANAGEMENT SYSTEM WITH ANONYMOUS PLAYER BONUSING

CROSS-REFERENCE TO RELATED APPLICATION

This application claims benefit of U.S. Provisional Patent Application Ser. No. 62/590,980, filed on Nov. 27, 2017, which is hereby incorporated by reference in its entirety for all purposes.

FIELD OF THE INVENTION

The present invention relates generally to casino management systems, and more particularly, to a casino management system that tracks un-carded anonymous players wagering sessions and/or accounts and provide system-based bonus awards to un-carded anonymous players.

BACKGROUND OF THE INVENTION

The growth and competition in the casino gaming market in recent years and the increasingly sophisticated and complex technology being integrated into the gaming environment, presents both challenges and opportunities to gaming establishment operators. Over recent years, casino revenue has dramatically increased in the area of non-gaming revenue sources such as, hotel and hospitality, retail, dining, entertainment and other casino products or services. Traditionally, patron tracking systems have focused on tracking patrons of electronic gaming machines, table games and other gaming revenue areas such as, bingo and keno. In this traditional scenario, a patron is identified during gaming play by a patron tracking ID card and/or a patron identification number (PIN). The patron tracking system tracks the patron's gaming play and may award patron tracking points, bonuses, and other incentives according to established criteria to promote continued patron loyalty.

In most cases, the patron tracking points earned by play electronic gaming machines, table games and other gaming revenue areas such as, bingo and keno may be redeemed for prizes, such as complimentary meals, merchandise, hotel and services through non-gaming revenue point-of-sales devices linked to the patron tracking system. However, there is an emerging category of casino patrons who are not members of the traditional casino patron club of electronic gaming machines, table games or other gaming revenue sources, yet spend large amount of money in gaming and non-gaming revenue areas. Traditional patron tracking systems do not track, rate or score this category of patron.

Some casinos utilize an entirely separate system which may be used to store, independently, both player tracking data and other information related to the casino resort patron. The other information may be relate to the patron's transactions or visit, or originate at, the hotel, restaurant(s), retail outlet(s), spa(s), etc. . . . . There are several problems with this approach. First, a completely different and additional system is used to receive the player tracking data (from the casino management system or CMS) and the other data and to store it. Secondly, such external systems must be tailored specifically to work with the CMS and other systems, such that the data from these systems is understood. In other words, the data from these systems is typically maintained in different formats and must be translated in order to be understood and stored. This is a very laborious and expensive undertaking. Furthermore, it is also difficult and expensive to maintain. For instance, if one of the underlying system changes, then the additional external system may also require corresponding updates.

The present invention is aimed at one or more of the problem as set forth above.

SUMMARY OF THE INVENTION

In different embodiments of the present invention, systems and methods for operating a gaming system including a casino management server, are provided.

In one embodiment of the present invention, a gaming system is provided. The gaming system includes a plurality of gaming machines and a casino management server coupled to the plurality of gaming machines. Each gaming machine includes a display device and a gaming controller configured to display a game to a player via the display device, and establish a gaming credit meter for use in placing wagers on the game by the player. The casino management server includes a processor for implementing a bonus award feature. The processor programmed to execute an algorithm including initiating the bonus award feature, identifying gaming machines associated with the bonus award feature, and determining a bonus award associated with the bonus award feature. The bonus award includes a first award value associated with a carded player account and a second award value associated with an un-carded anonymous player wagering session and/or account. The processor selects gaming machines having gaming sessions associated with un-carded anonymous player wagering sessions and/or accounts and displays, on each selected gaming machine, a message notifying the player of the first award value associated with a carded player account and the second award value associated with an un-carded anonymous player wagering session and/or account. The processor also downloads the second award value to a corresponding gaming credit meter of each selected gaming machine associated with un-carded anonymous player wagering sessions and/or accounts.

In another embodiment, a casino management server for use in gaming system including a plurality of gaming machines is provided. Each gaming machine includes a display device and a gaming controller configured to display a game to a player via the display device and establish a gaming credit meter for use in placing wagers on the game by the player. The casino management server includes a memory device configured to store a plurality of carded player account wagering sessions and a plurality of un-carded anonymous player wagering session and/or accounts and a processor coupled to the plurality of gaming machines for implementing a bonus award feature. The processor is programmed to execute an algorithm including initiating a bonus award feature, identifying gaming machines associated with the bonus award feature, and determining a bonus award associated with the bonus award feature. The bonus award includes a first award value associated with a carded player account and a second award value associated with an un-carded anonymous player based upon their wagering session or account. The processor selects gaming machines having gaming sessions associated with un-carded anonymous players and displays, on each selected gaming machine, a message notifying the player of the first award value associated with a carded player account and the second award value associated with an un-carded anonymous player. The processor also downloads the second award value to a corresponding gaming credit meter of each selected gaming machine associated with un-carded anonymous player.

In yet another embodiment, a non-transitory computer-readable storage medium storing computer executable instructions is provided. The computer executable instructions cause a processor to implement a bonus award feature by performing the algorithm steps of initiating the bonus award feature, identifying gaming machines associated with the bonus award feature, and determining a bonus award associated with the bonus award feature. The bonus award includes a first award value associated with a carded player account and a second award value associated with an un-carded anonymous player based upon their wagering session or account. The processor selects gaming machines having gaming sessions associated with un-carded anonymous players and displays, on each selected gaming machine, a message notifying the player of the first award value associated with a carded player account and the second award value associated with an un-carded anonymous player. The processor also downloads the second award value to a corresponding gaming credit meter of each selected gaming machine associated with un-carded anonymous player wagering sessions and/or accounts.

BRIEF DESCRIPTION OF THE DRAWINGS

Other advantages of the present invention will be readily appreciated as the same becomes better understood by reference to the following detailed description when considered in connection with the accompanying drawings wherein:

FIGS. 9-12 are illustrations of exemplary database records generated by the gaming system shown in FIG. 1, according to embodiments of the present invention;

FIGS. 26-30 are illustrations of exemplary data files generated by the system shown in FIGS. 1 and 20, according to embodiments of the present invention.

Corresponding reference characters indicate corresponding parts throughout the drawings.

DETAILED DESCRIPTION OF INVENTION

Figure 1:
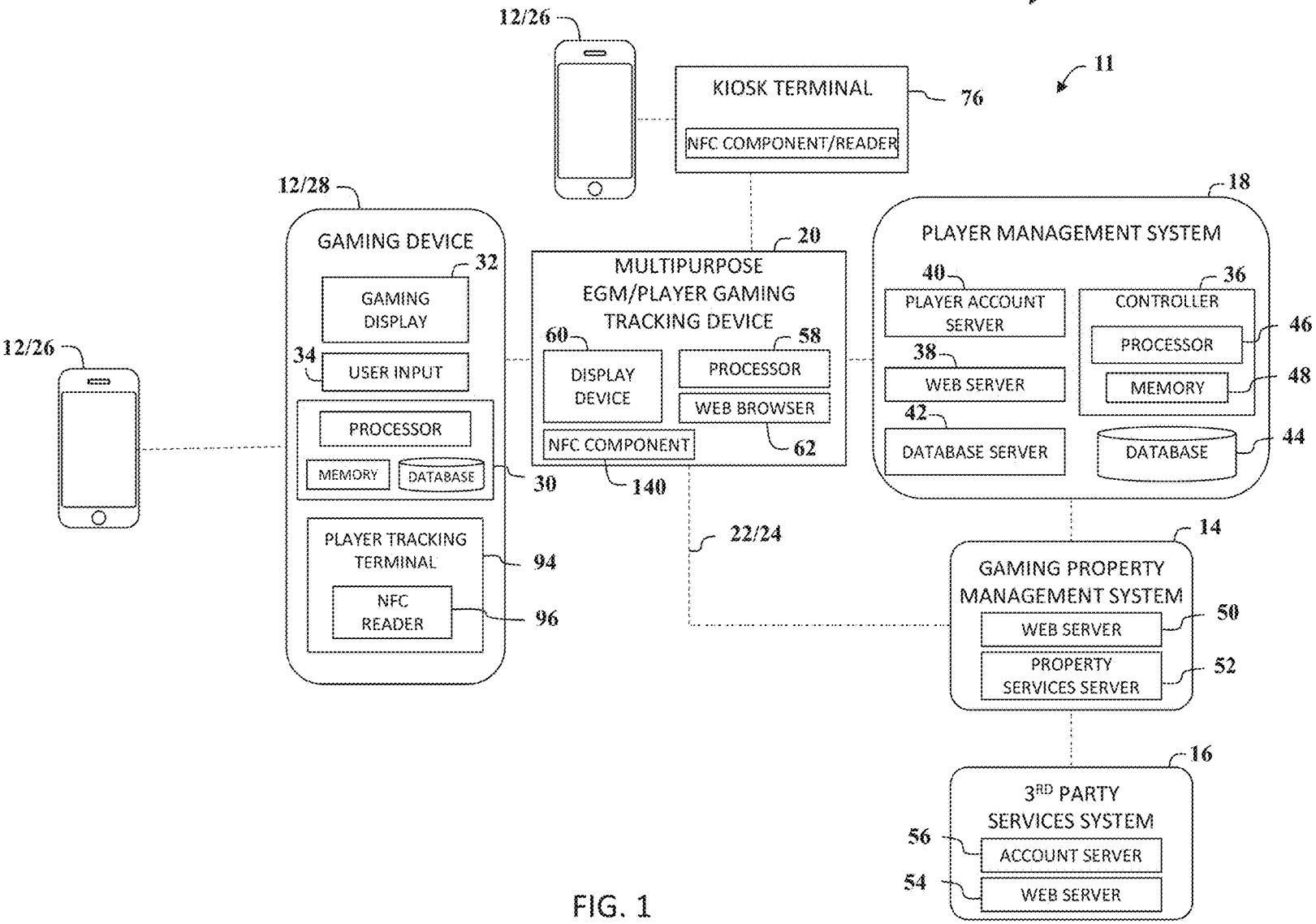
FIG. 1 is a schematic representation of an exemplary gaming system for providing gaming property services to players via a gaming device, according to an embodiment of the present invention.

With reference to the drawings, and in operation, the present invention improves the function of known casino management systems by providing a casino management system that establishes a method to track un-carded anonymous players sessions that are used to provide system-based bonus awards to players using gaming devices such as, for example, electronic gaming machines (EMGs), electronic table games (ETGs), Table Games, Kiosks, and/or point-of-sale terminals. In general, the system of the present invention includes a casino management server that is programmed to provide floor-wide system-based bonus awards to carded patrons using carded player tracking accounts that are accessed by players using unique player tracking IDs incorporated into physical player tracking cards, NFC devices, or other technologies for uniquely identifying a player. The casino management server is also programed to track un-carded anonymous player wagering sessions when gaming sessions are initiated by players that do not have carded player tracking accounts or unique player tracking IDs, monitors the gaming activity associated with the gaming sessions, and initiates floor-wide system-based bonus award features that include active gaming sessions associated with both carded player tracking accounts and un-carded anonymous players. In addition, casino management server is programmed to provide notification message on gaming devices associated with un-carded anonymous players that include an amount of the bonus award provided to the un-carded anonymous player and, in some cases, to also display the amount being provided to carded players to notify the un-carded anonymous player of the larger award being provided to carded players to encourage them to join the loyalty club.

In addition, the casino management server that is programmed to display a unique web-based interface that allows casino operators to establish bonus awards associated with the bonus award features including establishing triggering events, award values provided to carded players, and award values provided to un-carded anonymous players. Moreover, the casino management server is programmed to establish rating (wagering) sessions for uncarded anonymous players. For example, within the rating system, the system creates slot ratings for patron 0 (uncarded) and opens a new rating based on 5 minutes of EGM idle time. The system targets these uncarded ratings to enhance Patron Bonusing modules, such as, for example, Hot Seat™ drawings (a.k.a. Mystery Bonusing™) Advanced Incentives™ and SuperSeries™, all published by Konami Gaming, Inc.™.

The present invention may also be implemented in the Konami SYNKROS™ system including the Advanced Incentives™, Hot Seat Draw™ and Super Series™ to bonus uncarded players that add credits directly to the EGM/ETG credit meter. The present invention may also implement the Konami SYNKROS™ system including the Advanced Incentives™ and Hot Seat Draw™ to bonus un-carded players at Table Games by providing them promotional chips or other table bonus instruments. For example, the enhanced SYNKROS™ Service Bus allows for external bonusing systems to add credits directly to the EGM/ETG credit meter. The Advanced Incentives™ Uncarded Enhancements include: new promotion type (EGM Credits) fix amount; new promotion type (EGM credit random) min/max/average; new uncarded selected box which reduces criteria tabs to Date Time, Device Type, Devices; and modified Patron meters tab for single uncarded rating>Amount as trigger. The Hot Seat Draw™ Uncarded Enhancements include new promotion type (EGM Credits); new promotion type (EGM credit random) min/max/average; uncarded rating to rating type; and allows for automated scheduling (recurrence). The Super Series™ Uncarded Bonusing Enhancements include: new Award type column for uncarded (EGM Credits); new auto select of five numbers for uncarded players; awarding uncarded players from the uncarded column, carded players from the carded column; and five number match winning the progressive (Locks the EGM). The invention also includes Synkros™ Service Bus Uncarded Bonusing Enhancements that include added external Bonusing credits to X-Series, Q-COM, SAS, and G2S EGMs through current integration with 3rd Party Jackpot Management Systems (JMS), and added external bonus command to the Synkros Service Bus that adds credits to the EGM credit meter via the command. In addition, the system implements anonymous player tracking via a facial recognition, and uses a camera or other means to attempt to do facial recognition of the player. The system assigns an anonymous player account (similar to a patron account; however, with only the player's photo) and a digital signature of the face, and assigns the uncarded rating (wagering) sessions to the new anonymous player account (or if based on the signature of the face a match is found, use that anonymous player account to assign the subsequent rating (wagering) sessions.

The present invention allows for additional play criteria metrics to target repeat anonymous players. (i.e., depending on the accuracy of the facial recognition signature matching, now that player is more or less tracked just like a carded player. In addition, the system provides for AML/BSA compliance and Suspicious Activity reporting. Depending on the accuracy of the facial recognition signature matching, now that player is more or less tracked just like a carded player. For cash-in or cash-out transactions that exceed $10,000 in a given gaming day, automate the suspicious activity reporting by supplying the anonymous image captured on the account along with the cash-in/cash-out transactions that total over $10,000 in a given gaming day.

Anonymous player account versus rating session. In one embodiment, without facial recognition images received from the EGM/ETG, the system 10 uses a method to track the anonymous (uncarded player) rating session, and may not create a player account. Moreover, with facial recognition images received from the EGM/ETG, the system 10 processes the unique biometric signature of the image to determine if the anonymous (un-carded player) has been given a unique un-carded anonymous player account, and: if so the rating session is recorded to that unique anonymous player account; and if not a unique anonymous player account is created for that unique biometric signature of the image, the current and subsequent rating sessions are recorded to that unique anonymous player account. Similarly, with table games having an associated with Host Workstation, without facial recognition, the system 10 allows the table games dealer to track the player as a refused name player, the current and subsequent rating sessions are recorded to that refused name player ID. The system may then implement Bonusing using promotional chips or other prize instruments. Table games with associated Host Workstation with facial recognition, the system 10 allows the table games dealer to track the player as a true anonymous player based on their unique biometric signature of the image, with the current and subsequent rating sessions recorded to that refused name player ID, and Bonusing using promotional chips or other prize instruments.

Displaying notification messages on gaming devices is optional and is not limited to displaying both what a carded player bonus is and an un-carded bonus. Additionally, in some cases, the bonus may only be given to un-carded players. In addition, bonus awards may include first awards for carded players and second awards for un-carded players. However, these awards may be of equal value, one higher and one lower (depending on casino marketing and preferences). Also, the system may provide a single award only to un-carded players.

In other embodiment, the system also allows patrons to access player tracking account information using information transmitted wirelessly using near field communication (NFC) devices. In one embodiment, the system 10 includes a player gaming tracking device that is coupled to an electronic gaming machine (EGM) and includes an NFC enabled device that receives and transmits data wirelessly to and/or from an NFC enabled device associated with a patron. For example, in one embodiment, the NFC enabled device of the player gaming tracking device may communicate wirelessly with a NFC enabled smartphone associated with the patron. The patron may wirelessly transmit information to the player gaming tracking device using the NFC enabled devices to access player tracking services provided by the system's player tracking servers. In addition, the system may also include kiosks including NFC enabled devices that allow patron's and/or casino operator employee's to access player account services using mobile computing devices having NFC enabled devices.

In addition, the system 10 may include NFC enabled player gaming tracking devices that are coupled to a gaming property server and configured to allow players to access player account services using player identification data transmitted wirelessly using NFC enabled devices to display gaming services provided by the gaming property server on a corresponding gaming machine.

The system 10 also allows a player to access services provided by the player tracking server via a NFC device on a mobile computing device and/or a NFC enabled card that allows the player/user to log into the player account using the player gaming tracking device associated with a gaming machine and/or a kiosk coupled to the player tracking server.

In addition, the system 10 may include a player gaming tracking device that includes a card reader configured to receive a physical card having player identification data encoded on a magnetic strip. The player gaming tracking device is configured to allow a player to log into the player's account by using the player tracking card and track the player's gaming activity, and simultaneously allow a casino operator employee to access the casino management system via the player gaming tracking device to transmit data to and/or from the employees NFC enabled mobile device and the NFC enabled player gaming tracking device. For example, the player may be playing the gaming machine while another user, gaming employee, with a priority higher than the player may also be able to access the same gaming machine to see the corresponding player tracking account, award a jackpot to a player, and/or any gaming related activities the gaming employee may have.

A selected embodiment of the invention will now be explained with reference to the drawings. It will be apparent to those skilled in the art from this disclosure that the following description of the embodiment of the invention is provided for illustration only and not for the purpose of limiting the invention as defined by the appended claims and their equivalents.

Figure 20:
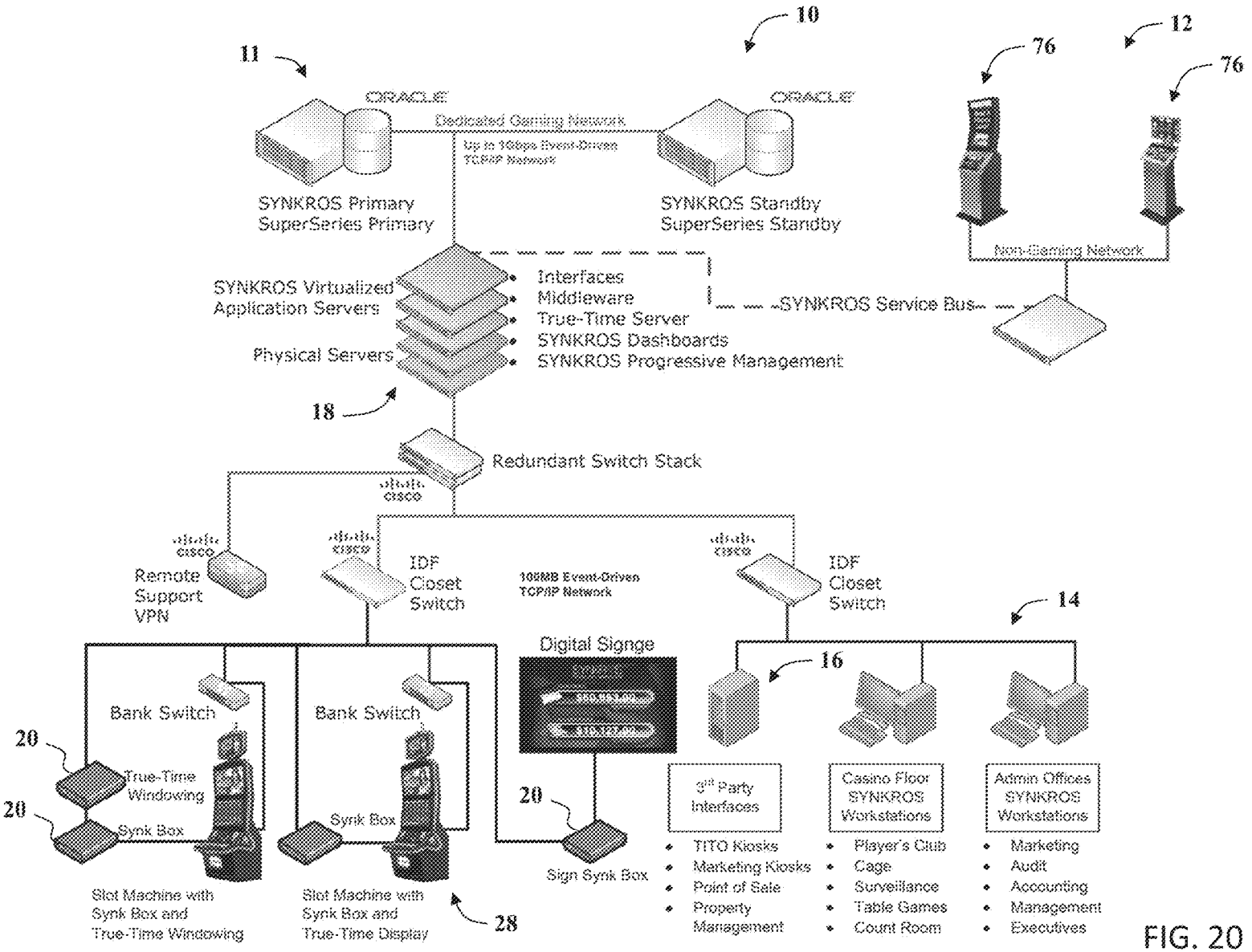
FIG. 20 is another schematic representation of the gaming system shown in FIG. 1, according to an embodiment of the present invention.

Referring to FIGS. 1 and 20, in the illustrated embodiment, the present invention includes a gaming system 10 that includes a casino management server system 11 that is coupled to a plurality of gaming devices 12 and a 3rd party services system 16. The casino management server system 11 includes a gaming property management and monitor system 14 and a player management system 18 that is connected to the gaming devices 12, the gaming property management and monitoring system 14, and the 3rd party services system 16. The system 10 also includes one or more player gaming tracking devices 20 that is coupled to a corresponding gaming device 12, a gaming property management and monitoring system 14, a 3rd party services system 16, and a player management system 18 to transmit and receive data to and/or from the gaming device 12, the gaming property management and monitoring system 14, the 3rd party services system 16, and the player management system 18 to display graphical interfaces on the gaming device 12 and to enable a user/player to log-in/log-out and to access and purchase goods and services provided by the gaming property management and monitoring system 14 and/or the 3rd party services system 16 via the gaming device 12.

In the illustrated embodiment, the player gaming tracking device 20, the gaming device 12, the gaming property management and monitoring system 14, the 3rd party services system 16, and the player management system 18, are coupled together via a communications link 22 that enables each gaming device 12 to access the player management system 18, the gaming property management and monitoring system 14, and/or the 3rd party services system 16 over a network 24 such as, for example, the Internet, a cellular telecommunications network, a wireless network and/or any suitable telecommunication network. For example, in one embodiment, the gaming device 12 includes a mobile computing device 26, e.g., a smartphone that communicates with the player management system 18 via the cellular telecommunications network and/or the Internet. In another embodiment, the gaming device 12 includes a gaming machine 28 (shown in FIG. 1). In yet another embodiment, the gaming device 12 may include a personal computer, laptop, cell phone, tablet computer, smartphone/tablet computer hybrid, personal data assistant, and/or any suitable computing device that enables a user to connect to the player management system 18 and display the graphical interfaces.

In the illustrated embodiment, each gaming device 12 includes a gaming controller 30 that is coupled to a gaming display 32 and a user input device 34. The gaming controller 30 receives and transmits information to and from the player gaming tracking device 20 and/or the player management system 18 and displays the graphical interfaces on the gaming display 32 to enable the user/player to interact with the player management system 18 and/or the player gaming tracking device 20 to access a player tracking account, access casino services, and purchase goods and/or services from the gaming property management and monitoring system 14 and/or the 3rd party services system 16 in accordance with the embodiments described herein.

In the illustrated embodiment, the player management system 18 includes a system controller 36, a web server 38, and a player account server 40, a database server 42 and a database 44. The servers 38-42, system controller 36, and database 44 are connected through a network 24 such as, for example, a local area network (LAN), a wide area network (WAN), dial-in-connections, cable modems, wireless modems, and/or special high-speed Integrated Services Digital Network (ISDN) lines.

The web server 38 communicates with the gaming devices 12, the gaming property management and monitoring system 14, and the 3rd party services system 16 to facilitate transmitting data over the network 24 via the Internet and/or the cellular network, respectively.

The database server 42 is connected to the database 44 to facilitate transmitting data to and from the database 44. The database 44 contains information on a variety of matters, such as, for example, player tracking ID(s), player account information, gaming property information, 3rd party information, image data for producing graphical interfaces and/or screens on the gaming device 12 and temporarily stores variables, parameters, and the like that are used by the system controller 36. In one embodiment, the database 44 includes a centralized database that is stored on the system 10 and is accessed directly via the gaming devices 12 and/or the player gaming tracking device 20. In an alternative embodiment, the database 44 is stored remotely from the system 10 and may be non-centralized.

The player account server 40 receives player tracking data from the player gaming tracking device 20 and generates and stores the received player tracking data in corresponding player accounts stored in the database 44. In addition, the player account server 40 retrieves a player account and transmits the player tracking data to the player gaming tracking device 20, the gaming device 12, the gaming property management and monitoring system 14 and/or the 3rd party services system 16. The player account server 40 also receives player tacking ID(s) that correspond to player accounts in order to log players in and out of the player gaming tracking device 20.

The system controller 36 includes a processor 46 and a memory device 48 that is coupled to the processor 46. The memory device 48 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the processor 46 to store, retrieve, and/or execute instructions and/or data.

The processor 46 executes various programs, and thereby controls other components of the system 10, the player gaming tracking device 20, and the gaming devices 12 according to user instructions and data received from the gaming devices 12. The processor 46 in particular executes a program, and thereby enables the system 10 to allow the player to access information, goods, and/or services provided by the player account server 40, the gaming property management and monitoring system 14, and the 3rd party services system 16 in response to user instructions received via the gaming devices 12 in accordance with the embodiments described herein. The memory device 48 stores programs and information used by the processor 46. Moreover, the memory device 48 stores and retrieves information in the database 44 including, but not limited to, image data for producing images and/or screens on the gaming display 32, and temporarily stores variables, parameters, and the like that are used by the processor 46.

In the illustrated embodiment, a player may use the gaming device 12 to access goods and services provided by the gaming property management and monitoring system 14 and/or the 3rd party services system 16 such as, for example, restaurant reservations, show reservations, casino services, hotel services, travel arrangements, and/or any suitable goods and/or services that enables the system 10 to function as described herein. In addition, the player may access a corresponding player tracking account with the gaming device 12 via a NFC reader. As described herein, the player may tap-on the NFC reader which identifies a unique player identifier (ID), from the mobile computing device 26 and/or an NFC enabled card, on the gaming device 12 that corresponds to a player tracking account. The player gaming tracking device 20 transmits the player ID to the player management system 18 to determine a corresponding player tracking account. The player gaming tracking device 20 may also receive the location ID associated with the gaming device 12 and transmit the player account information and the gaming device location ID to the gaming property management and monitoring system 14 and/or the 3rd party services system 16. The gaming property management and monitoring system 14 and/or the 3rd party services system 16 may select services associated with the received player account information and/or the gaming device location and transmit data indicative of the selected services to the player management system 18 and/or the player gaming tracking device 20 to display the services on the gaming device 12.

In the illustrated embodiment, the gaming property management and monitoring system 14 includes a web server 50 that is configured to facilitate communication of data to and/or from the player gaming tracking device 20, the player management system 18, and/or the 3rd party services system 16. The gaming property management and monitoring system 14 may also include a property services server 52 that is configured to transmit data indicative of goods and services offered by the gaming property to the player management system 18 and/or the player gaming tracking device 20 as a function of the received player ID and/or gaming device location. The 3rd party services system 16 includes a web server 54 to facilitate communicating with the gaming property management and monitoring system 14 and/or the player management system 18, and an account server 56 that is configured to transmit data indicative of the goods and services provided by the 3rd party service system as a function of the received player ID and/or the gaming device location.

In the illustrated embodiment, the player gaming tracking device 20 is coupled to the gaming device 12 and the gaming property management and monitoring system 14 to receive gaming property services from the gaming property management and monitoring system 14 and display the gaming property services on the gaming display 32. Moreover, the player gaming tracking device 20 is configured to receive gaming property services from the gaming property server and transmit services data indicative of the gaming property services to the gaming device 12. In one embodiment, the player gaming tracking device 20 is a gaming tracking device or a multipurpose EGM/player tracking device that is connected to one or more gaming machines 12. Additional details of multipurpose EGM/player tracking devices, which may be used in the present invention, are described in U.S. patent application Ser. No. 12/235,237 to Edward Sepich et al., now U.S. Pat. No. 8,429,229, filed Sep. 22, 2008, titled "Multipurpose EGM/player Tracking Device and System", which is incorporated herein by reference in its entirety.

In the illustrated embodiment, the player gaming tracking device 20 includes a processor 58 and a display device 60 configured to control and/or drive the gaming display 32 included with the gaming device 12. The player gaming tracking device 20 also includes a web browser program 62 for use by the processor 58 to generate and display a web browser interface 64. The web browser interface 64 enables a player to access the gaming property services via a website provided by the gaming property management and monitoring system 14. In one embodiment, the player gaming tracking device 20 is configured to receive webpage data indicative of the gaming property services from the gaming property web server 50 and/or the 3rd Party web server 54, generate a services webpage as a function of the received webpage data, and transmit the services webpage to the gaming device 12 for use in displaying the services webpage on the gaming display 32. In addition, the player gaming tracking device 20 may be configured to transmit between the player and the gaming property server 50 and/or server 54 via the services webpage to facilitate providing gaming property services to the player. In another embodiment, the player gaming tracking device 20 is configured to detect, read, receive, and transmit near field communication (NFC) data between the mobile computing device and the gaming property server 50 to log the player into and out of the player gaming tracking device 20.

In the illustrated embodiment, the display device 60 is configured to display a player interaction screen 66 (shown in FIGS. 31-32) including a gaming content section 68 and a non-gaming content section 70 using a picture-in-picture display. For example, in one embodiment, the gaming tracking device 80 includes a True Time Windows™ computer program that drives a picture-in-picture gaming display, as described in U.S. patent applicaton Ser. No. 14/488,174 to Jeffrey D. George et al., now U.S. Pat. No. 9,619,962, filed Sep. 16, 2014, titled "System and Methods of Providing Player Services with Gaming Devices", which is incorporated herein by reference in its entirety.

Moreover, the display device 60 displays a game 72 being generated by the gaming controller 30 within the gaming content section 68 and displays a services website 74 in the non-gaming content section 70. More specifically, the display device 60 is configured to receive game data indicative of game play from the gaming controller 30, receive services data indicative of the services web site 74 including the gaming property services from the player gaming tracking device 20 and display the game and the gaming property services on the player interaction screen 66. In one embodiment, the gaming display 32 includes a touchscreen. The display device 60 relates player selections received via the touchscreen to the player gaming tracking device 20 to enable the player gaming tracking device 20 to allow the player to interact with the services website 74 via the touchscreen. Similarly, the display device 60 transmits player selections to the gaming controller 30 to enable the gaming controller 30 to conduct game play in response to players' selections. In the illustrated embodiment, the display device 60 may adjust a size, orientation, and/or position of each of the gaming content section 68 and the non-gaming content section 70 based on the input received from the player. For example, in one embodiment, the display device 60 may allow the player to select a region on the touchscreen corresponding to the services website 74 being displayed in the non-gaming content section 70 and enlarge the non-gaming content section 70 to allow a larger portion of the services website 74 to be viewable to the player on the gaming display 32.

In one embodiment, the player gaming tracking device 20 may display advertising information received from the gaming property server 50 and/or the 3rd party server 54 in the non-gaming content section 70 of the player interaction screen 66. In addition, the player gaming tracking device 20 may receive and display a live video broadcast image of a sporting event, gaming tournament, or special event provided by the gaming property server 50 and/or the 3rd party server 54. In addition, the player gaming tracking device 20 may display images indicative of bonus feature games, such as progressive games, slot tournaments, and/or system based awards that are received for the player management system 18. In addition, the player gaming tracking device 20 may display player information obtained from a player account associated with the player in the non-gaming content section 70.

In one embodiment, the player gaming tracking device 20 is configured to transmit a webpage request to the gaming property server 50 and/or server 54 to display the services webpage on the gaming display 32. The webpage request may include a URL and a unique player identifier associated with the player for use by the gaming property management and monitoring system 14 to determine the gaming property services provided to the player as a function of the unique player identifier. Moreover, the player gaming tracking device 20 may be configured to determine a unique machine identifier associated with the gaming device 12 and transmit the webpage request including the unique machine identifier to the gaming property server 50 to enable the gaming property management and monitoring system 14 to determine a location of the gaming device 12 as a function of the unique machine identifier, and to determine the gaming property services being provided to the player as a function of the location of the gaming device 12.

The player gaming tracking device 20 may also monitor and track the property services being accessed by the player via the web site 74, and generate and transmit tracking data indicative of the player's activity and services accessed through the web site to the player management system 18 for use in storing the tracking data in a corresponding player account. In addition, the player gaming tracking device 20 may determine if the player purchases one or more gaming property services through the services web site 74 and responsively provide an award to the player as a function of the purchased gaming property service. For example, in one embodiment, the gaming property may provide an incentive to the player to use the services website. The player gaming tracking device 20 may detect when the player accesses the services website and provide bonus points, loyalty points, and/or cashless wagering credits to the player as an award for accessing and/or purchasing gaming property services via the services website 74.

In one embodiment, the player gaming tracking device 20 may be configured to determine a player account associated with the player as a function of the unique player ID, and allow the player to purchase gaming property services via the services web site 74 using bonus points contained in the player account. In addition, the player gaming tracking device 20 may allow the player to purchase gaming property services via the services webpage 74 using cashless wagering credits associated with the player account. For example, in one embodiment, the player gaming tracking device 20 may determine a player account associated with the player as a function of the unique player identifier, determine an amount of bonus points and cashless wagering credits included in the player account; and allow the player to purchase gaming property services via the services website with the bonus points and cashless credits included in the player account.

Figure 2:
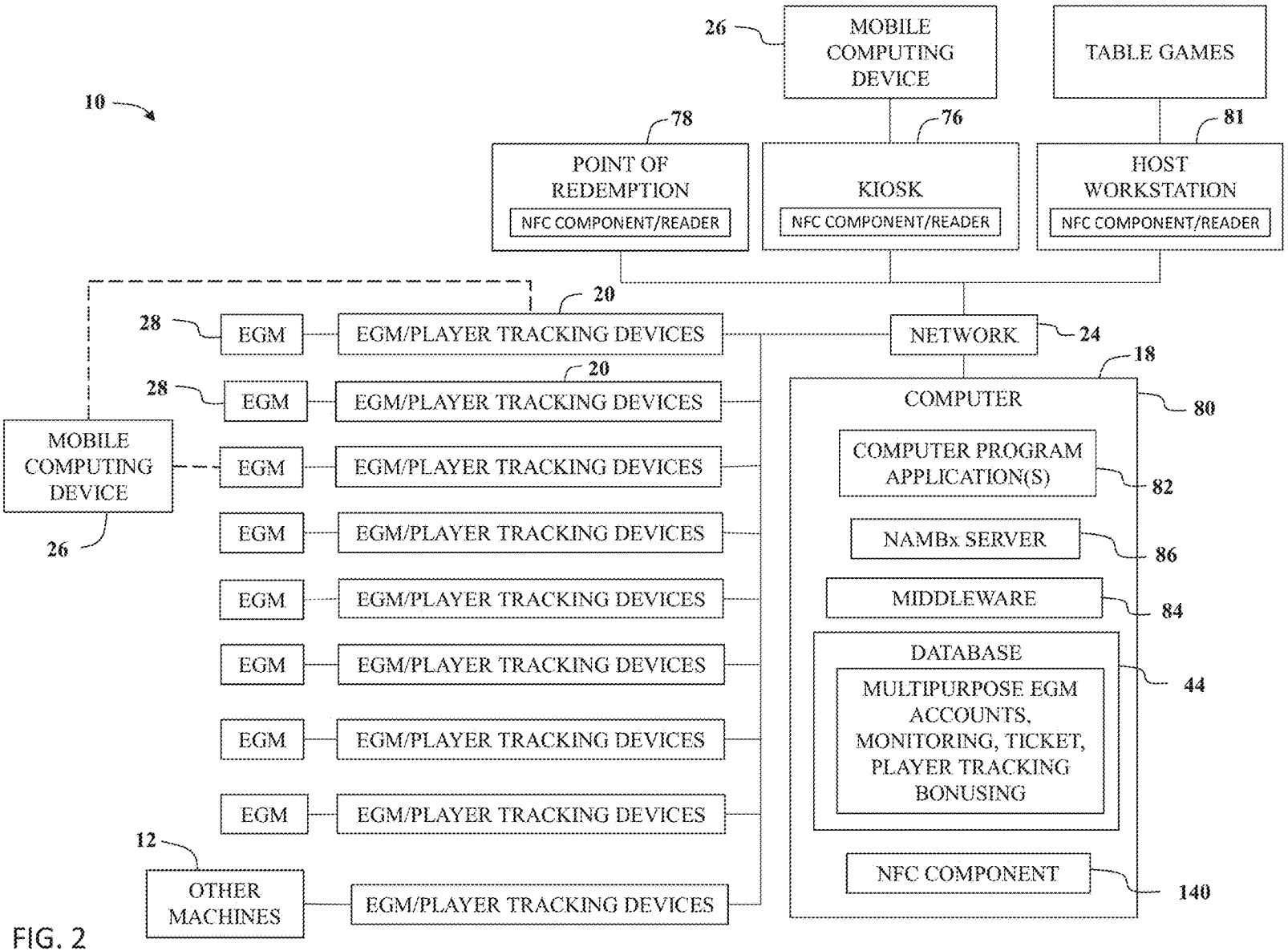
FIGS. 2 and 3 are additional schematic representations of the gaming system shown in FIG. 1, according to an embodiment of the present invention.

Referring to FIG. 2, in the illustrated embodiment, the system 10 may be configured to provide accounting, monitoring, and/or other gaming related services, such as, ticketing, progressives, gaming attending, and/or EGM interaction services, and provide a player additional services, such as, player tracking, points management, bonusing, multimedia content and/or entertainment services. For example, in one embodiment, the system 10 may be embodied or implemented via an entertaining management and monitoring system (shown in FIG. 2) and may include many additional functions such as real-time multi-site, EGM accounting, EGM monitoring, player tracking, cage credit and vault, sports book, Point of Sale (POS) accounting, keno accounting, bingo accounting, and table game accounting, a wide area progressive jackpot, and electronic funds transfer (EFT), as well as interfaces to other gaming and non-gaming systems. In addition, the system 10 may be configured to track data related to the play of one or more gaming devices 12. Two such systems are disclosed in U.S. patent application Ser. No. 11/094,605, filed Mar. 30, 2005, which is hereby incorporated by reference.

As shown, the system 10 includes a plurality of EGMs 28. Gaming machines 28 may include, but are not limited to, EGMs, electronic gaming machines (such as video slot, video poker machines, or video arcade games), multi-terminal electronic gaming machines, server-based gaming machines, virtual EGMs, e.g., for online gaming, and an interface to a table management system (not shown) for table games, or other suitable devices at which a user may interact or access a user or player account. In the illustrated embodiment, eight electronic game machines (EGMs) 28 are shown. However, it should be noted that the present invention is not limited to any number or type of gaming machine 28. In one embodiment, the gaming machines 28 are organized into banks (not shown), each bank containing a plurality of gaming machines 28. Moreover, the system 10 may include other types of gaming devices 12 such as, for example, kiosks 76 and/or point of sale or redemption terminals 78.

In the illustrated embodiment, the player management system 18 may include one or more host computers 80. The gaming machines 28 are connected via a network 24 to one or more host computers 80, which are generally located at a remote or central location. The host computer 80 includes computer program application(s) 82 which maintains one or more databases 44. The computer program application(s) 82 and databases 44 may be used to record, track, and report accounting and monitoring information regarding the EGMs 28 and players and/or gaming attendant/casino employee interaction via the gaming devices 12 through the NFC reader of the player gaming tracking device 20. Additionally, the computer program application(s) 82 and databases 44 may be used to maintain information related to player or player tracking accounts. One or more host workstations 81 may be coupled to the host computer 80 to allow a casino operator employee to access the host computer 80 via the host computer workstation 81. Moreover, the Host Workstation 81 may be used to enter table game rating (wagering) sessions for both carded and anonymous players (often referred to as refused named players). The system 10 may be configured to provide anonymous player Bonusing based on the play session triggers to these players in the form of promotional chips or other prize instruments.

In general, the gaming machines 28 may be used by a user or player, i.e., to access their player account or services through the player gaming tracking device 20, i.e., the multipurpose EGM/player tracking device. Examples of player services include, but are not limited to, accessing and performing operations on (1) point and complementary point balances, (2) accessing and performing operations on awards such as, bonuses, incentives, progressives etc., (3) accessing and performing operations on saved player preferences and account information such as, PIN, default language, show/hide points, and other player and Bonusing features. For example, the player may select one of the gaming machines 28 to play a game and insert a coin, credit, coupon, tap on with a NFC enabled device or card and/or player tracking card (not shown) into the chosen gaming machine 28. Generally, the gaming machine 28 has an associated number of credits or coins required in order to play. In the case of video slot or poker games, the game is played and an award or Bonus in the form of credits or other complementary points may be awarded through the multipurpose EGM/player gaming tracking device 20 to the gaming machine 28. In the case where the user is a gaming attendant and/or gaming property employee, the gaming attendant may interact with the multipurpose EGM/player gaming tracking device 20 to access gaming machine 28 services, such as, perform a fill, acknowledge a jackpot, link or associate a particular multipurpose EGM/player tracking device to the gaming machine 28, interrogate gaming machine 28 meters, bill insertions and other access or perform other EGM specific gaming services. For example, the gaming property employee may be able to log into the EGM while the player is still logged in, in order to award the player with a jackpot (described herein). The player card or player tracking ID does not have to be logged out in order for the employee to card-in and award the jackpot while the player is still carded in or logged into the EGM 28.

In one embodiment, the player management system 18 may also include one or more middleware servers 84. Each middleware server 84 being associated with one or more gaming machines 28. The middleware server 84 acts as go-between between the associated gaming machines 28 and multipurpose EGM/player gaming tracking device 20 and one or more database servers 42 which are used to provide game services, e.g., progressive awards, player tracking services, accounting services, and the like. The player management system 18 may also include a NAMB2 server 86 that may be used to download software executables to each multipurpose EGM/player gaming tracking device 20 and uses a checksum process (e.g., MDxSUM signature) to verify the software. The NAMB2 server 86 may also provide entertainment audio or video streams to each multipurpose EGM/player gaming tracking device 20 over the communications link 22 as well as other player and gaming attendant services such as, remote help, Internet access, and non-gaming revenue services such as, reservations, valet, shopping, and others.

Figure 3:
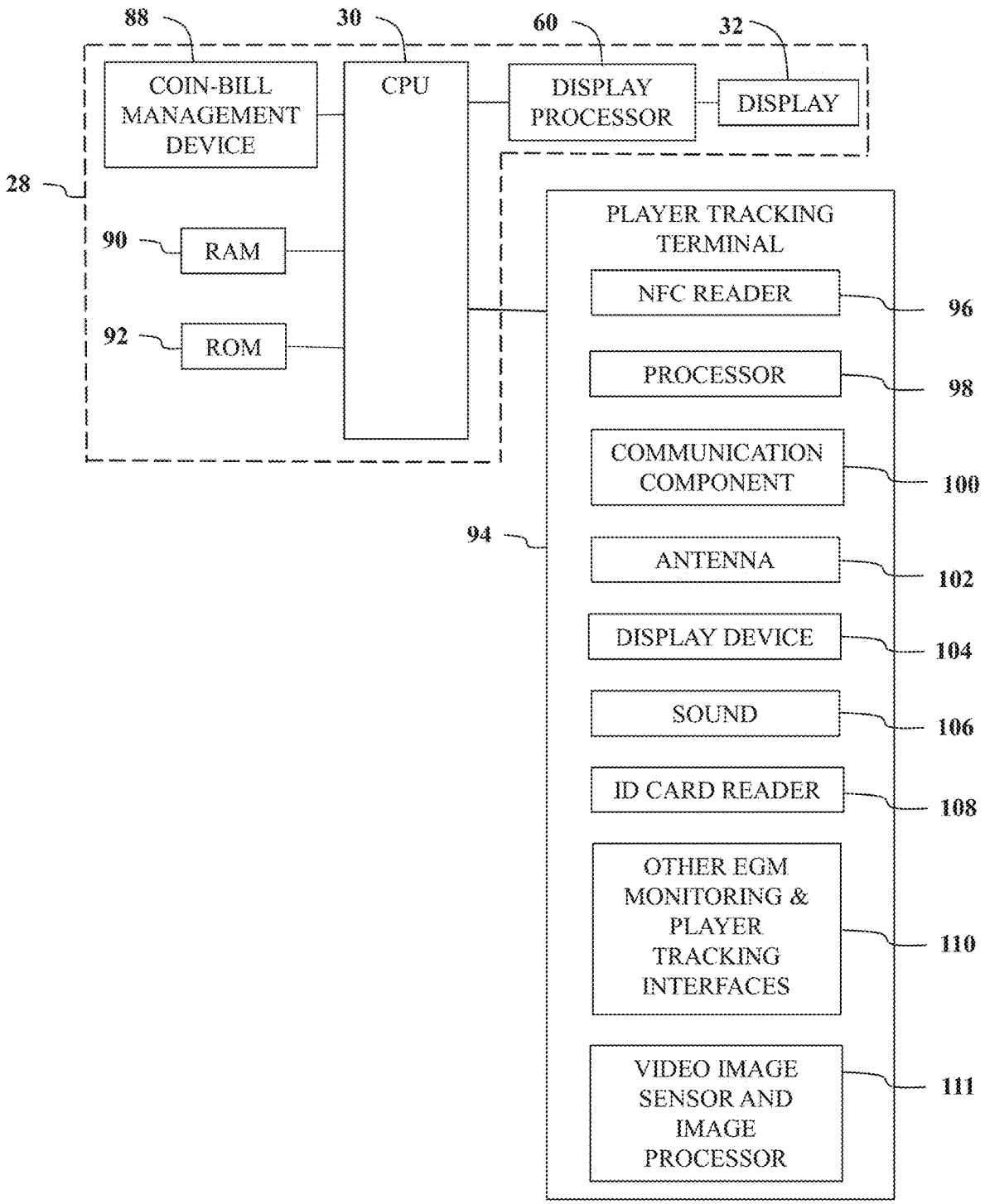

With reference to FIG. 3, in one embodiment, the gaming machine 28 may include gaming controller 30, or central processing unit (CPU), a coin-bill management device 88, a display processor/device 60, a RAM 90 as a memory device and a ROM 92 (generally provided as an EPROM). The CPU 30 is mainly composed of a microprocessor unit and performs various calculations and motion control necessary for the progress of the game. The coin-bill management device 88 detects the insertion of a coin or a bill and performs a necessary process for managing the coin and the bill. The display processor 60 interprets commands issued from the CPU 30 and displays desirable images on a display 32. The RAM 90 temporarily stores programs and data necessary for the progress of the game, and the ROM 92 stores, in advance, programs and data for controlling basic operation of the EGM 28, such as the booting operation thereof, game code and graphics. Input to the EGM 28 may be accomplished via mechanical switches or buttons or via a touchscreen interface (not shown).

In one embodiment, the player gaming tracking device 20 may include a player tracking terminal device 94 that is coupled to the gaming machine 28 for use in identifying a player and/or gaming attendant to access player accounts stored on the database 44. The player or gaming attendant user is identified via a player tracking ID via the NFC component of the mobile computing device (or NFC enabled card) and/or any other method of identifying the player or gaming attendant, such as, finger print, optical recognition, etc., via the NFC reader at each gaming machine 28. In addition, the player or gaming attendant user may be identified via the NFC component (NFC card or mobile computing device) and the player tracking ID on the Point of Service (POS), the Property Management Systems (PMS), Kiosks, or any other interfaced external system. The player tracking ID is associated with a specific player account. Player accounts may be used, generally, to provide bonuses to a player, in addition to the award designated by, in the case of a video slot or poker machine, the gaming machine 28 paytable. These bonuses may be awarded to the player based on a set of criteria, including, but not limited to, a) the player's play on the EGM 28, b) the player's overall play, c) play during a predetermined period of time, and d) the player's birthday or anniversary, or e) any other definable criteria. Additionally, bonuses may be awarded on a random basis, i.e., to a randomly chosen player or randomly chosen game including table games. Bonuses may also be awarded in a discretionary manner or based on other criteria, such as, purchases made at a gift shop or other affiliated location. Additionally, bonuses may be awarded to the player from any other gaming or non-gaming source, such as, Point of Service (POS), Property Management Systems (PMS), Kiosks, or any other interfaced external system.

Bonus awards may be provided to a player and stored in a corresponding player account for use by the player to purchase goods and/or services offered by the gaming property via the services website 74 and/or for placing wagers on games being played on the gaming machine 28. In one embodiment, bonus awards include bonus points that may include incentive points. Incentive points may be exchanged for game play, gifts and/or property services, such as hats, t-shirts, meals, shows, and/or property amenities such as spa/pool services, nightclub services, etc.

In another embodiment, the bonus points may also be convertible to gaming credits, which may be designated as cashable or non-cashable. Cashable credits, or incentive points converted into credits, may be downloaded to a gaming machine 28. When the player has finished playing the EGM 28, any remaining credits may be cashed out, i.e., retrieved as coins or placed on a printed ticket or associated with the player account to be accessed by the player tracking ID for redemption or play on another gaming machine 28. In addition, cashable credits may be used to purchase goods and/or services provided by the gaming property management system 14 and/or the 3rd party services system 16 via the services website 74 displayed on the gaming machine 28.

Non-cashable credits must be used for game play and/or wagering on games being played with the gaming machine. When the player stops playing an EGM 28, any remaining non-cashable credits which were downloaded to the EGM 28 are either lost or uploaded back to the player account that is associated with the player tracking ID.

In one embodiment, the player tracking terminal 94 may include, a near field communication (NFC) reader 96, a processor 98, and/or a numeric keypad (not shown), a communications component 100, an antenna 102, a display 104, a sound project device 106, a player identification card reader 108, and other EGM monitoring and player/gaming attendant tracking interfaces 110. In one embodiment, the display 104 is a touchscreen panel and the numeric keypad (not shown) is implemented thereon. In one embodiment, the player tracking terminal 94 may include a video image capture system 111 configured to capture video images of a player seated in from a corresponding gaming machine. For example, the video image capture system 111 may include a video image sensor for capturing video images, and a processor coupled to the video image sensor for processing images captured by the image sensor and transmit the capture images to the player management system 18. In one embodiment, the video image sensor is included in a camera 113 (shown in FIG. 14) mounted to an outer surface of the player tracking terminal display 104.

The player may be identified by entry of a player tracking ID via NFC communication to the NFC reader 96 and entry of a player identification number (PIN) on the numeric key pad or touch screen panel display 104 or any other method of identifying the player or gaming attendant, such as, finger print, optical recognition, etc.

Figure 4:
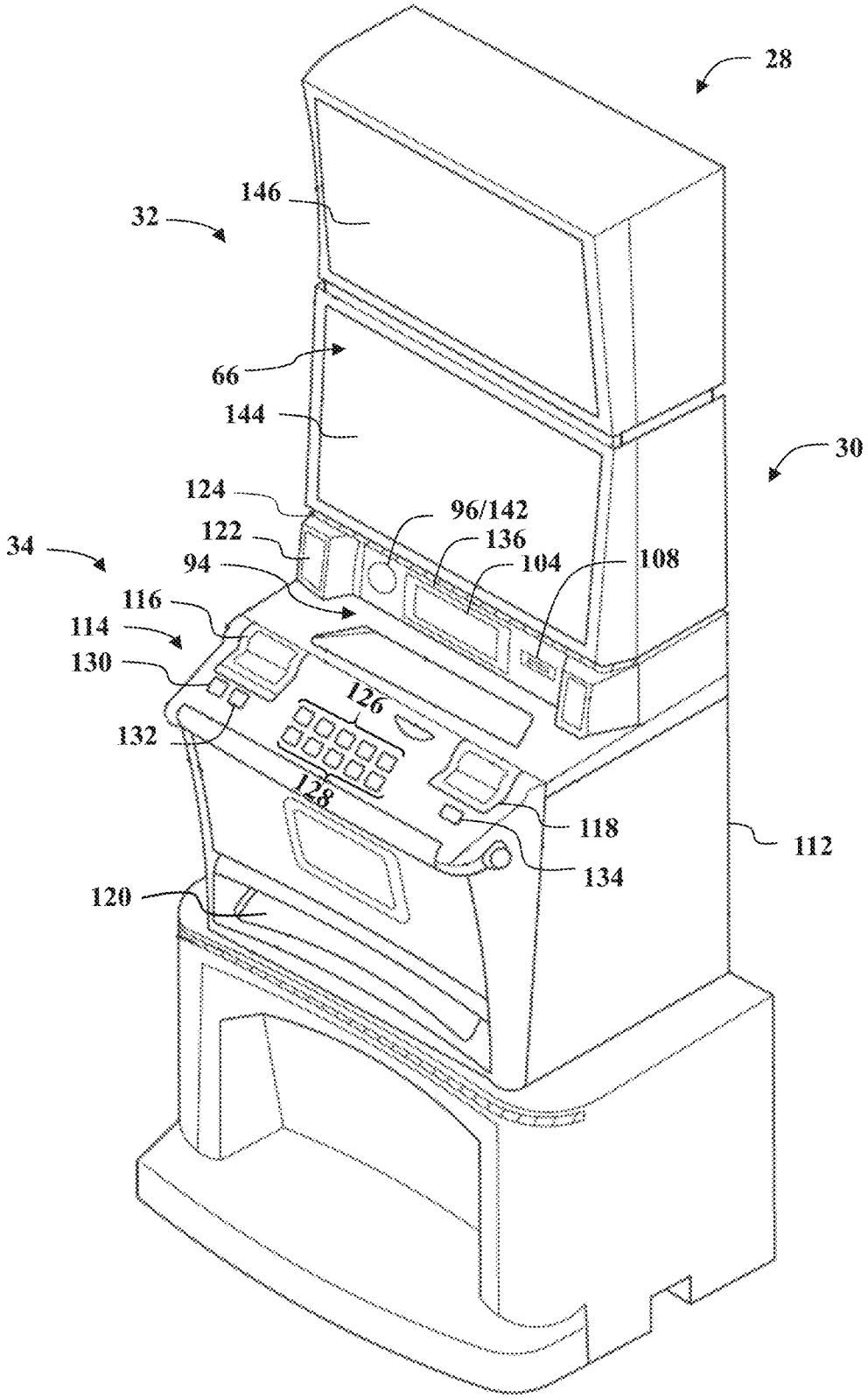
FIG. 4 is a perspective view of an exemplary gaming device that may be used with the gaming system shown in FIGS. 1-3, according to an embodiment of the present invention.
Figure 5:
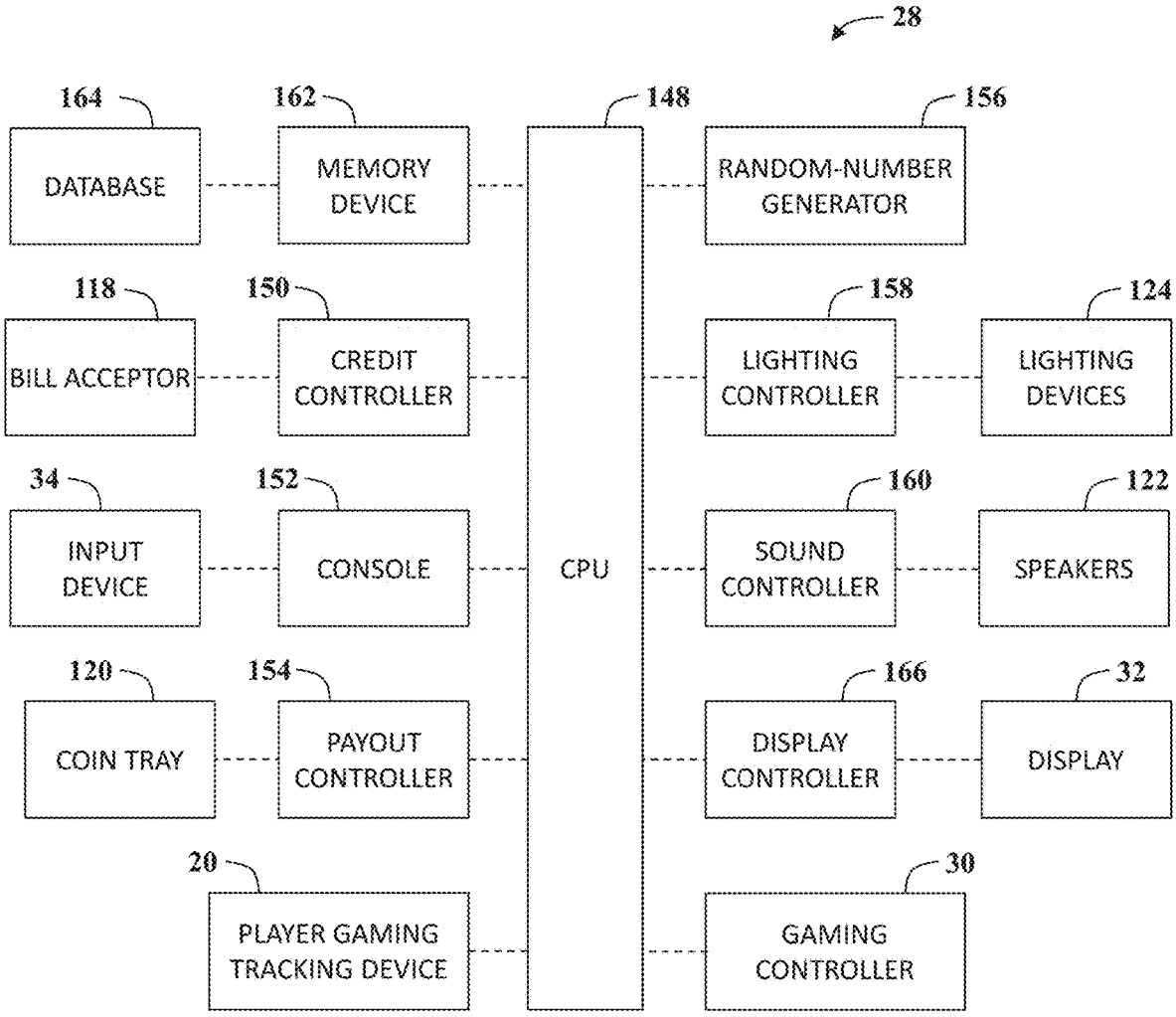
FIG. 5 is a schematic representation of the gaming device shown in FIG. 1, according to an embodiment of the present invention.

FIG. 4 is a perspective view of an exemplary gaming machine 28. FIG. 5 is a schematic representation of the gaming device 28. In the illustrated embodiment, the gaming machine 28 is a video gaming machine preferably installed in a casino. In the illustrated embodiment, the gaming machine 28 includes the gaming display 32 for displaying a plurality of games, the user input device 34 to enable a player to interface with the gaming machine 28, the player tracking terminal 94 for logging players in and out of the EGM 28, and the gaming controller 30 that is operatively coupled to the gaming display 32, the player tracking terminal 94, and the user input device 34 to enable a player to play games displayed on the gaming display 32. The gaming machine 28 also includes a cabinet assembly 112 that is configured to support the gaming display 32, the user input device 34, the player tracking terminal 94, and/or the gaming controller 30 from a gaming stand and/or a supporting surface.

In one embodiment, the user input device 34 includes a plurality of input buttons 114, a coin slot 116, and/or a bill acceptor 118. The coin slot 116 includes an opening that is configured to receive coins and/or tokens deposited by the player into the gaming machine 28. The gaming machine 28 converts a value of the coins and/or tokens to a corresponding amount of gaming credits that are used by the player to wager on games played on the gaming machine 28.

The bill acceptor 118 includes an input and output device that is configured to accept a bill, a ticket, and/or a cash card into the bill acceptor 118 to enable an amount of gaming credits associated with a monetary value of the bills, ticket, and/or cash card to be credited to the gaming machine 28. Moreover, the gaming machine 28 may also utilize a cashless wagering system (not shown), such as a ticket in ticket out (TITO) system (not shown). In one embodiment, the bill acceptor 118 also includes a printer (not shown) that is configured to dispense a printed voucher ticket that includes information indicative of an amount of credits and/or money paid out to the player by the gaming machine 28 during a gaming session. The voucher ticket may be used at other gaming machines, or redeemed for cash, and/or other items as part of a casino cashless system (not shown).

A coin tray 120 is coupled to the cabinet assembly 112 and is configured to receive a plurality of coins that are dispensed from the gaming machine 28. One or more speakers 122 are installed inside the cabinet assembly 112 to generate voice announcements and/or sound effects associated with game play. The gaming machine 28 also includes one or more lighting devices 124 that are configured to blink and/or change brightness and color in specific patterns to produce lighting effects to enhance a visual gaming experience for the player.

In one embodiment, the input buttons 114 include a plurality of BET switches 126 for inputting a wager on a game, a plurality of selection switches 128 for selecting a betting line and/or card, a MAXBET switch 130 for inputting a maximum wager, a PAYOUT switch 132 for ending a gaming session and dispensing accumulated gaming credits to the player, and a start switch, i.e., a SPIN/DEAL button 134 to initiate an output of a game.

In the illustrated embodiment, the BET switches include five switches from 1BET to 5BET to enable a player to wager between a minimum bet up to 5× minimum bet. Each selection switch corresponds to a betting line such as, for example, a payline and/or symbol for a reel game, one or more cards for a card game, and/or a symbol for a roulette game, to enable a player to associate a wager with one or more betting lines. The MAXBET switch enables a player to input the maximum bet that a player can spend against one play of a game. The PAYOUT switch enables a player to receive the amount of money and/or credits awarded to the player during a gaming session, which has been credited onto the gaming machine 28.

The gaming machine 28 may also include the player tracking terminal 94 that is coupled to the gaming controller 30 and to the player gaming tracking device 20 for identifying the player and/or a player tracking account that is associated with the player. The player tracking account may include, but is not limited to, gaming credits available to the player for use in playing the gaming machine 28. The player tracking terminal 94 is configured to communicate player account information between the player management system 18, the player gaming tracking device 20, and the gaming machine 28. For example, the player tracking terminal 94 may be used to track bonus points and/or credits awarded to the player during a gaming session and/or track bonus and/or credits downloaded to the gaming machine 28 from the player management system 18.

In one embodiment, the player tracking terminal 94 is coupled to the gaming cabinet assembly 112 and includes the near field communication (NFC) reader 96, the data display 104, the player identification card reader 108, and the keypad 136. The NFC reader 96 is configured to accept proximity-based communication that may enable any suitable contactless proximity-based transactions or communications between the mobile computing device and/or a NFC enabled card and the EGM 28. The NFC reader 96 may detect, read, or otherwise receive NFC communication 138 from the mobile computing device 26 and/or the NFC enabled card, which may transmit information including the player tracking ID to identify the player account information. The mobile computing device 26 may be within a certain distance or proximity to the NFC reader in order to send and receive the NFC communications 138. After the NFC reader 96 receives the NFC communication 138 from the mobile computing device 26 and/or NFC enabled card, the keypad 136 is configured to accept a user selection input such as, for example, a unique player personal identification number (PIN) to facilitate enabling the gaming machine 28 to identify the player, and access player account information associated with the identified player to be displayed on the data display 104. In one embodiment, the data display 104 includes a touchscreen panel that includes the keypad 136. Alternatively, the data display 104 and the keypad 136 may be included in the gaming display 32.

In another embodiment, the NFC reader 96 may support a tap-on for the "card-in." The NFC reader 96 may receive from a NFC component 140 the player tracking ID to log the player into SYNKROS. Illustrated in FIGS. 14-16, the NFC reader 96 includes a light 142 that may change colors depending on the action event data received (described herein). The NFC reader also includes, but is not limited to, an antenna 102 that is in the center of the reader, a NFC reader ring 142 that may light up different colors, and a plastic Lexan over the black portion of NFC reader with either a character like a smiley face, the casinos' logo or even the SKYNKROS logo provided it does not interfere with the NFC reader. When the mobile computing device 26 is within proximity to the NFC reader, and after a successful log-in, the NFC reader ring 142 may light up green shown in FIG. 14. If the log-in is unsuccessful the NFC reader light 142 may light up red and the gaming display 104 may display a message such as, for example, "Please, insert your card again" or "Please try again" (shown in FIG. 15). In addition, if there is not a mobile computing device 26 within a predetermined proximity to the NFC reader 96, the NFC reader ring 142 may light up blue indicating that no card or NFC enabled device are within the area of the EGM 28 (shown in FIG. 16). In another embodiment, shown in FIGS. 17-19, the NFC light ring may be a different light shape, depending on the placement of the NFC antenna and interference from the lighting.

In addition, once the player enters the PIN, the player may accept an award (anonymous Bonusing to a temporary account) and/or the player may enter a PIN to receive a preloaded NFC enabled card that includes cash for a cashless system (anonymous cashless wagering).

In one embodiment, the gaming display 32 includes a first display 144 and a second display 146. The first display 144 is configured to display the player interaction screen 66 including indicia and/or symbols for use in a game, e.g., cards used by a card game, roulette wheel and symbols used in a roulette game, and reels used in a reel game. The player interaction screen 66 may include any type of game including, but not limited to, a video slot game, a keno game, a blackjack game, a video poker game, or any type of game which allows a player to make a wager, play a game, and potentially provide the player an award based on an outcome of the game and a paytable. The player interaction screen 66 may also include a gaming area 68 and a player interaction area 70. The gaming area 68 is configured to display the game 72 and the player interaction area 70 is configured to display a player interaction screen 66.

The second display 146 is configured to display game play instructions for performing the game including, but not limited to, playing instructions, paytables, paylines, betting lines and/or any other information to enable the gaming machine 28 to function as described herein. Moreover, each display 144 and 146 may be configured to display at least a portion of the player interaction screen 66 and/or game play instructions. In one embodiment, the first and second displays 144 and 146 each include a flat panel display, such as a cathode ray tube display (CRT), a liquid crystal display (LCD), a light-emitting diode display (LED), a plasma display, and/or any suitable visual output device capable of displaying graphical data and/or text to a user. Alternatively, a single component, such as a touch screen, may function as both the gaming display 32 and as the user input device 34. In an alternative embodiment, the first display 144 and/or the second display 146 includes a plurality of mechanical reels displaying a plurality of game symbols.

Referring to FIG. 5, in one embodiment, the gaming controller 30 includes a processor, i.e., a central processing unit (CPU) 148, the gaming controller 30, a credit controller 150, a console unit 152, a payout controller 154, a random-number generator (RNG) 156, a lighting controller 158, a sound controller 160, a memory device 162, a database 164, and a display controller 166. The memory device 162 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the CPU 148 to store, retrieve, and/or execute instructions and/or data.

The CPU 148 executes various programs, and thereby controls other components of the gaming machine 28 according to player instructions and data accepted by the user input device 34 and/or the gaming display 32. The gaming controller 30 in particular executes a game program, and thereby conducts a game in accordance with the embodiments described herein. The memory device 162 stores programs and databases used by the gaming controller 30. Moreover, the memory device 162 stores and retrieves information in the database 164 including, but not limited to, a game type, a number of reels associated with a game, a number of symbol positions being displayed on each reel, a type of symbols being displayed on each symbol position, a predefined set of normal symbols, a predefined set of special symbols, image data for producing game images and/or screens on the gaming display 32, and temporarily stores variables, parameters, and the like that are used by the gaming controller 30. In addition, the memory device 162 stores indicia, symbol weights, paytables, and/or winning combination tables which represent relationships between combinations of random numbers and types of awards. In one embodiment, the memory device 162 utilizes RAM to temporarily store programs and data necessary for the progress of the game, and EPROM to store, in advance, programs and data for controlling basic operation of the gaming machine 28, such as the booting operation thereof.

The credit controller 150 manages the amount of player's credits, which is equivalent to the amount of coins and bills counted and validated by the bill acceptor 118. The console unit 152 is coupled to the user input device 34 to monitor player selections received through the input buttons 114, and accept various instructions and data that a player enters through the input buttons 114. The payout controller 154 converts a player's credits to coins, bills, or other monetary data by using the coin tray 120 and/or for use in dispensing a credit voucher via the bill acceptor 118.

The lighting controller 158 controls one or more lighting devices 124 to blink and/or change brightness and color in specific patterns in order to produce lighting effects associated with game play. The sound controller 160 controls the speakers 122 to output voice announcements and sound effects during game play.

The RNG 156 generates and outputs random numbers to the gaming controller 30 preferably at the start of each round of a game. The gaming controller 30 uses the random numbers to determine an outcome of the game. For example, if the game is a video slot game, the gaming controller 30 uses the RNG 156 to randomly select an arrangement of symbols to be displayed on video reels. Moreover, the gaming controller 30 generally uses random numbers generated by the RNG 156 to play the games and to determine whether or not to provide an award to a player. In addition, the gaming controller 30 generates game outcomes including combinations of random numbers, and compares the generated combinations with winning combinations stored in the winning combination table to determine if the generated outcome is a winning outcome that is associated with a type of award.

The display controller 166 controls the gaming display 32 to display various images on screens preferably by using computer graphics and image data stored in the memory device 162. More specifically, the display controller 166 controls video reels in a game screen displayed on the first display 144 and/or the second display 146 by using computer graphics and the image data. The display controller 166 is connected to the display device 60 for receiving image data indicative of the player interaction screen 66 for use in displaying the player interaction screen 66 on the gaming display 32. In one embodiment, the display device 60 may be configured to perform the function and operation of the display controller 166 and may be housed within the gaming cabinet assembly 112 of the gaming machine 28. Moreover, the display device 60 may be connected directly to the gaming display 32 to control the gaming display 32 to display various images on screens preferably by using computer graphics and image data stored in the memory device 162.

For example, in one embodiment, a non-gaming machine may include a mobile computing device 26 that is configured to transmit and receive data to and/or from the host computer 80 to display graphical interfaces to enable a user to interact with and operate the system 10 with the mobile computing device 26. In the illustrated embodiment, the host computer 80 is coupled to each mobile computing device 26 via the communications network 22 that enables each mobile computing device 26 to access the host computer 80 over the network 24 such as, for example, the Internet, a cellular telecommunications network, a wireless network and/or any suitable telecommunication network. For example, in one embodiment, the mobile computing device 26 may include a mobile computing device, e.g., a smartphone that communicates with the host computer 80 via the cellular telecommunications network and/or the Internet. In another embodiment, the mobile computing device may include a personal computer, laptop, cell phone, tablet computer, smartphone/tablet computer hybrid, personal data assistant, and/or any suitable computing device that enables a user to connect to the host computer 80.

The mobile computing device 26 may include any suitable device that enables the user to access and communicate with the system 10 including sending and/or receiving information to and from the system 10 and displaying information received from the system 10 to the user. For example, in one embodiment, the mobile computing device 26 may include, but is not limited to, a tablet computer, a smartphone/tablet computer hybrid, a personal data assistant, a handheld mobile device including a cellular telephone, and the like. The mobile computing device 26, as well as any other connected computer systems and their components included in the system 10, can create message related data and exchange message related data (e.g., near field communication ("NFC") payloads, Bluetooth packets, Internet Protocol ("IP") datagrams and other higher layer protocols that utilize IP datagrams, such as, Transmission Control Protocol ("TCP"), Hypertext Transfer Protocol ("HTTP"), Simple Mail Transfer Protocol ("SMTP"), etc.) over the network.

Figure 6:
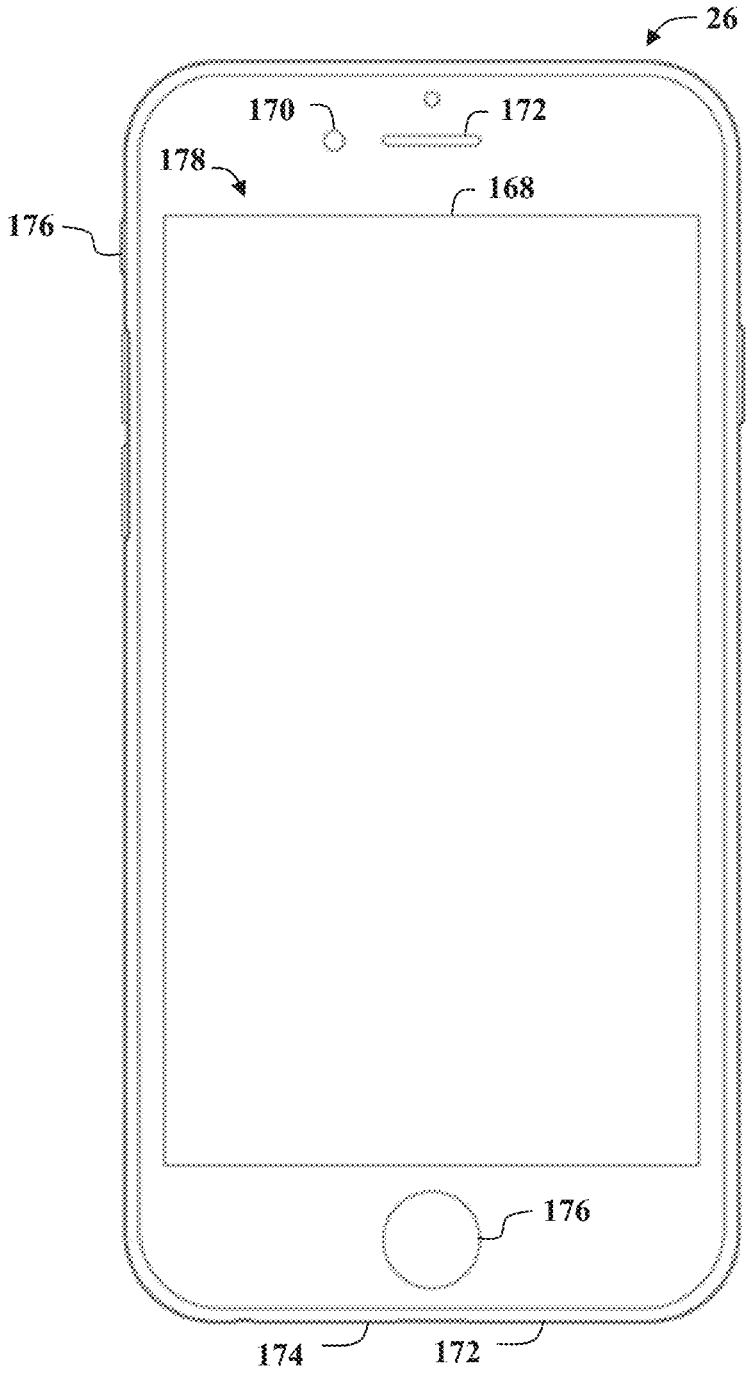
FIGS. 6-8 are illustrations of schematic components of the gaming system shown in FIG. 1, according to the embodiment of the present invention.

In one embodiment, the mobile computing device 26 (shown in FIG. 6) includes, for example, a smartphone such as an iPhone™. The mobile computing device 26 includes a processor coupled to a memory device, a NFC component 140, and a database for storing various programs and data for use in operating the mobile computing device 26. The mobile computing device 26 may also include a touchscreen display device 168, one or more video image cameras 170, one or more speakers 172, a microphone 174, at least one input button 176, and one or more sensors including, but not limited to, a touch ID fingerprint sensor coupled to an input button 176, a barometer, a three-axis gyro, an accelerometer, proximity sensor, and an ambient light sensor. In addition, the mobile computing device 26 may also include a Wi-Fi antenna, a cellular network antenna, a Bluethooth™ communications device, assisted GPS and GLONASS, a digital compass, and an iBeacon™ microlocation device.

In the illustrated embodiment, the mobile computing device 26 includes a web browser programmed and stored in the memory device. The processor executes the web browser program to display web pages on the touchscreen display device 168 that includes information received from the player account server 40 to enable the user to interact with and operate the player account server 40. In addition, the mobile computing device 26 may be programmed to store and execute a mobile program application, e.g., a mobile application, that displays a user interface 178 (shown in FIG. 6) on the touch screen display device 168 that allows the user to access the player account server 40 to retrieve and store information within the database server 42 as well as interact with and operate the player account server 40. In addition, in one embodiment, the system 10 may install one or more mobile application programs in the memory device of the mobile computing device 26. When initiated by the processor of the mobile computing device 26, the mobile application program causes the processor of the mobile computing device 26 to perform some or all of the functions of the player account server 40.

In another embodiment, the user may interact with the player account server 40 to manage a current player account 212 (shown in FIGS. 9 and 26) via a player account ID 180 and a player tracking card ID 182 or sign-up and receive a temporary player ID to enable the player to communicate with the EGM 28. Once the temporary player ID is associated with the player account ID 180, the player may manage the player account 212 and communicate with the EGM 28 via NFC communication 138.

Figure 7:
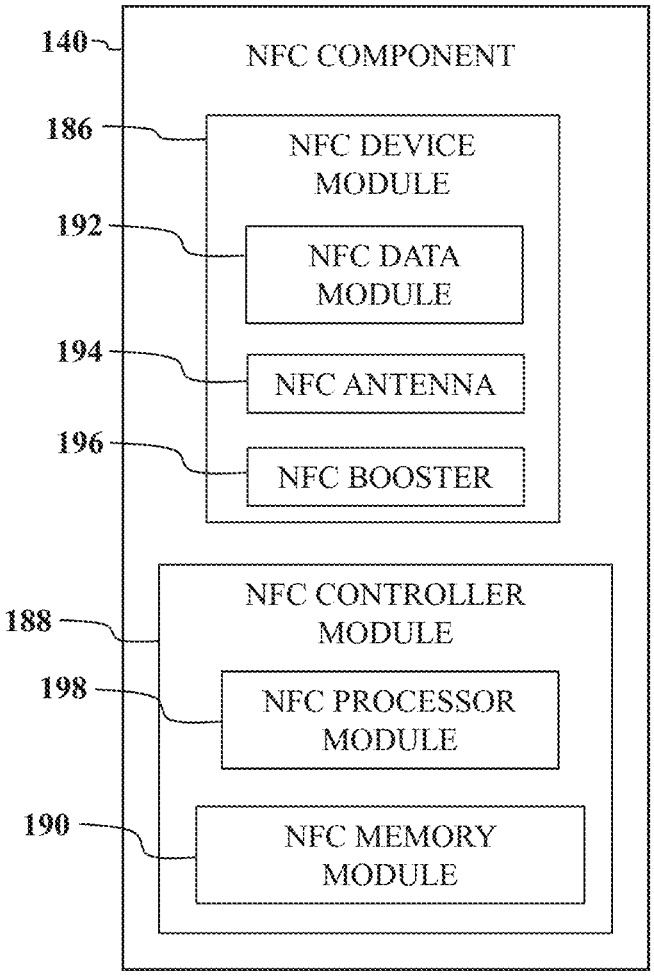

The NFC component 140 of the mobile computing device 26 may include a plurality of modules for enabling contactless proximity-based communication 138 between the mobile computing device 26 and the EGM 28. As shown in FIG. 7, for example, the NFC component 140 may include an NFC device module 186, an NFC controller module 188, and an NFC memory module 190. In addition, the NFC device module 186 may include an NFC data module 192, an NFC antenna 194, and an NFC booster 196. The NFC data module 192 may be configured to contain, route, or otherwise provide any suitable data that may be transmitted by the NFC component 140 to the EGM 28 via the NFC reader 96 as part of a contactless proximity-based or NFC communication 138. Additionally, the NFC data module 192 may be configured to contain, route, or otherwise receive any suitable data that may be received by the NFC component 140 from the EGM 28 as part of a contactless proximity-based communication 138. For example, the NFC component 140 may send the player tracking ID 182 via NFC communication 138 to the NFC reader 96 of the EGM 28 to log the player into the EGM 28. The EGM 28 may then send the player tracking ID 182 to the database 44 to be associated with a player account ID 180 and corresponding player account 212.

In another embodiment, the NFC transceiver or NFC antenna 194 may be any suitable antenna or other suitable transceiver circuitry that may generally enable communication or NFC communication 138 from the NFC data module 192 to the EGM 28 and/or to the NFC data module 192 from the EGM 28. Overall, the NFC antenna 194 (e.g., a loop antenna) may be provided specifically for enabling the contactless proximity-based communication capabilities of the NFC component 140.

In one embodiment, the NFC component 140 may utilize the same transceiver circuitry or antenna 194 that another communication component may utilize of the mobile computing device 26. For example, the communication component 100 may leverage the antenna 194 to enable Wi-Fi, Bluetooth™, cellular, or GPS communication between the mobile computing device 26 and another remote entity, while the NFC component 140 may leverage the antenna 194 to enable contactless proximity-based or NFC communication 138 between the NFC data module 192 of the NFC device module 186 and another entity (e.g., EGM 28). In another embodiment, the NFC device module 186 may include the NFC booster 196, which may be configured to provide appropriate signal amplification for data of the NFC component 140 (e.g., data within NFC data module 192) so that such data may be appropriately transmitted by the shared antenna 194 as NFC communication 138 to the EGM 28. For example, the shared antenna 194 may require amplification from the booster 196 before the antenna 194 (e.g., a non-loop antenna) may be properly enabled for communicating contactless proximity-based or NFC communication 138 between the mobile computing device 26 and the EGM 28 (e.g., more power may be needed to transmit the NFC data using the antenna 194 than may be needed to transmit other types of data using the antenna 194).

The NFC controller module 188 may include at least one NFC processor module 198. The NFC processor module 198 may operate in conjunction with the NFC device module 186 to enable, activate, allow, and/or otherwise control the NFC component 140 for communicating the NFC communication 138 between the mobile computing device 26 and the EGM 28. The NFC processor module 198 may exist as a separate component, may be integrated into another chipset, or may be integrated with the processor, for example, as part of a system on a chip ("SoC"), for example on a NFC enabled card. The NFC controller module 188 may include one or more protocols, such as the Near Field Communication Interface and Protocols ("NFCIP-1"), for communicating with another NFC device (e.g., EGM 28). The protocols may be used to adapt the communication speed and to designate one of the connected devices as the initiator device that controls the near field communication.

The NFC controller module 188 may control the near field communication mode of the NFC component 140. For example, the NFC processor module 198 may be configured to switch the NFC device module 186 between a reader/writer mode for reading information (e.g., communication 138) from NFC tags (e.g., from the EGM 28) to the NFC data module 186, a peer-to-peer mode for exchanging data (e.g., NFC communication 138) with another NFC enabled device (e.g., EGM 28), and a card simulation mode for allowing another NFC enabled device (e.g., EGM 28) to read information (e.g., NFC communication 138) from the NFC data module 186. The NFC controller module 188 also may be configured to switch the NFC component 140 between active and passive modes.

The NFC memory module 190 may operate in conjunction with the NFC device module 186 and/or the NFC controller module 188 to allow for NFC communication 138 between the mobile computing device 26 and the EGM 28. The NFC memory module 190 may be embedded within the NFC device hardware or within an NFC integrated circuit ("IC"). In addition, the NFC memory module 190 may be tamper resistant and may provide at least a portion of a secure element. For example, the secure element may be configured to prompt the player to enter a PIN after receiving the NFC communication from the mobile computing device 26. Therefore, requiring a two-step method for a player to log into the EGM 28.

In another embodiment, the NFC reader 96 may allow for close range communication at relatively low rates (e.g., 424 kbps), and may comply with any suitable standards such as ISO/IEC 7816, ISO/IEC 18092, ECMA-340, ISO/IEC 21481, ECMA-352, ISO 14443, and/or ISO 15693. Additionally, the NFC reader 96 may allow for close range communication at relatively high data rates (e.g., 370 Mbps), and may comply with any suitable standards, such as the TransferJet™ protocol. Communication between the NFC reader 96 and the mobile computing device 26 and/or the NFC enabled card may occur within any suitable close range distance between the mobile computing device 26 and the EGM 28, such as a range of approximately 2 to 4 centimeters, and may operate at any suitable frequency (e.g., 13.56 MHz). For example, such close range communication of the NFC reader 96 may take place via magnetic field induction, which may allow the NFC reader 96 to communicate with other NFC devices and/or to retrieve information from player tracking ID(s) having radio frequency identification ("RFID") circuitry. The NFC reader 96 may also provide a way of logging into the EGM 28, logging out of the EGM 28, and otherwise communicating with an external device (e.g., NFC component 140 of the mobile computing device 26).

The NFC communication 138 between the EGM 28 and the mobile computing device 26 may occur wirelessly and may not require a clear line of sight between the respective devices. The NFC communication 138 may be passive 200 or active 202. When passive, the NFC communication 138 may only be activated when the mobile computing device 26 is within a response range 204 of the NFC reader 96 on the EGM 28. For example, the NFC reader 96 of the EGM 28 may emit a relatively low power radio wave field that may be used to power an antenna utilized by the NFC device module 186 and enable that antenna to transmit suitable NFC communication 138 information from the NFC data module 192 of the mobile computing device 26, via the antenna 194 to the NFC reader 96 on the EGM 28. When active, the NFC device module 186 may incorporate or otherwise have access to a power source local to the mobile computing device 26 that may enable a shared antenna 194 or NFC specific antenna to actively transmit NFC communication information 138 from the NFC data module 192, via the antenna 194 to the NFC reader 96 of the EGM 28 as NFC communication 138, rather than reflect radio frequency signals, as in the case of a passive NFC communication 138.

In another embodiment, the NFC reader 96 of the EGM 28 may include a NFC component 140 the same as or similar to the NFC component 140 of the mobile computing device 26 to send and receive NFC communication 138. In addition, the NFC component 140 may be included in a "tag" or a sticker or on a specific NFC enabled card.

In another embodiment, once the player is done playing on the EGM 28, the player may log out or tap-out of the EGM 28 by tapping the NFC component 140 within the proximity to the NFC reader 96. The player may be logged off SYNKROS and the resulting uncarded or attract screen will again be shown (shown in FIG. 16, the blue NFC reader 96). In addition, the player tracking terminal 94 may include a log-off button on the player screens if there are no credits on the game after 30 seconds to 1 minute of inactivity. If there are no credits on the game, the player may be automatically logged off, and the screen may return to the NFC reader 96 with the NFC light 142 blue. The existing method may be abandoning the NFC component 140 time-out if the conditions for the abandoned card timer are reached, then a force card-out and return to the TTD/TTW screen may be displayed to attract new players to the EGM 28. In addition, the NFC reader 96 may include a motion detector, camera, and/or range/proximity capability to determine whether the NFC component 140 of the mobile computing device 26 is still within proximity to the NFC reader 96. Once the NFC component 140 is no longer within proximity to the NFC reader 96, the player tracking ID 182 may be logged-off or signed-off the EGM 28.

In one embodiment, the player may use a mobile application to sign up and receive the temporary player tracking ID. The player may use the temporary player tracking ID to track the gaming data on the EGM 28. The player may visit the player's club or a casino host to confirm the player identity and meet the casino age requirement and are not self-barred/casino-barred, and then convert the temporary account into a SYNKROS account including all temporary play and base point accruals on the previously tracked activity. In addition the possible methods to sign up for the temporary user account include but are not limited to a URL (website), a downloaded application, and/or any other method to receive a temporary player account. If the player is already in proximity to the NFC reader 96, the mobile computing device 26 may receive a request to sign-up as a temporary member. The player gaming tracking device 20 may communicate to the database 44 to create the temporary player tracking ID for the player and the player may then follow up to verify the account as described above. In addition, the player may enter the information on the True-Time Display (Picture-in-Picture), but would still have to verify the player tracking ID and account information to create a permanent player account.

While the NFC component 140 has been described with respect to near field communication, it is to be understood that the NFC component 140 may be configured to provide any suitable contactless proximity-based mobile log-in/log-out or any other suitable type of contactless proximity-based communication between the mobile computing device 26 and the EGM 28. For example, the NFC component 140 may be configured to provide any suitable short-range communication, such as those involving electromagnetic/electrostatic coupling technologies.

In another embodiment, the system 10 may develop a plugin for Android™ or Apple IOS™ to allow a player to add their SYNKROS card number to the existing phone to broadcast the player tracking ID 182 using the phone's NFC component and to be used to tap-in/tap-off versus an NFC encoded card. In addition, some mobile computing devices may not be capable of plugging into the NFC component 140 of the device and the player tracking ID 182 may correspond to an NFC component 140 on a NFC enabled card or a sticker (tag). The NFC enabled cards may include a NFC component 140 that is the same as or similar to the NFC component 140 of the mobile computing device 26.

In the illustrated embodiment, the system 10 is configured to transmit data indicative of the player interaction screen 66 to the gaming device 12 to enable the player to access the player management system 18, the gaming property management and monitoring system 14, and/or the 3rd party service system 16 via the gaming device 12. The system 10 is configured to display the player interaction screen 66 including a web browser that enables the player to interact with the systems 14, 16, and 18 through a web interface. In the illustrated embodiment, the gaming device 12 is configured to simultaneously display a game and the player interaction screen 66 on the gaming device 12 to enable the player to play the game and to purchase goods and services, and/or access player account information via the gaming device 12.

The system 10 includes embedded software that runs on the SYNK Box, e.g., player gaming tracking device 20, and includes a generic touch screen enabled web browser (similar to Internet Explorer). When configured with True Time Display hardware (Picture-in-Picture on the EGM 28), a side panel can be used to establish a touch screen enabled web browser session to the casino web server 50.

Referring to FIG. 1, the embedded web browser 62 establishes a connection to the casino web server 50. As part of the URL request, the SYNKROS Player ID, as well as the SYNKROS EGM ID of the EGM 28, that the player is playing is sent.

In another embodiment, Atrient (or another Kiosk vendor) is configured to provide a plurality of functions including, producing compatible NFC enabled cards for player enrollment, sending the NFC component with a player tracking ID 182 via the SYNKROS service bus to enroll the player, and/or allowing access to update the fields that control club membership via the SYNKROS service bus. In addition, the SYNKROS service bus may be configured to accept creations and updates to the club membership fields stored in SYNKROS.

In the illustrated embodiment, the host computer 80 is configured to store the patron data records including but not limited to, the player tracking ID(s) 182 that are associated with player accounts 180. The host computer 80 includes a CPU 206 that is coupled to the database 44, a communication module 208, and a patron tracking module 210.

Figure 8:
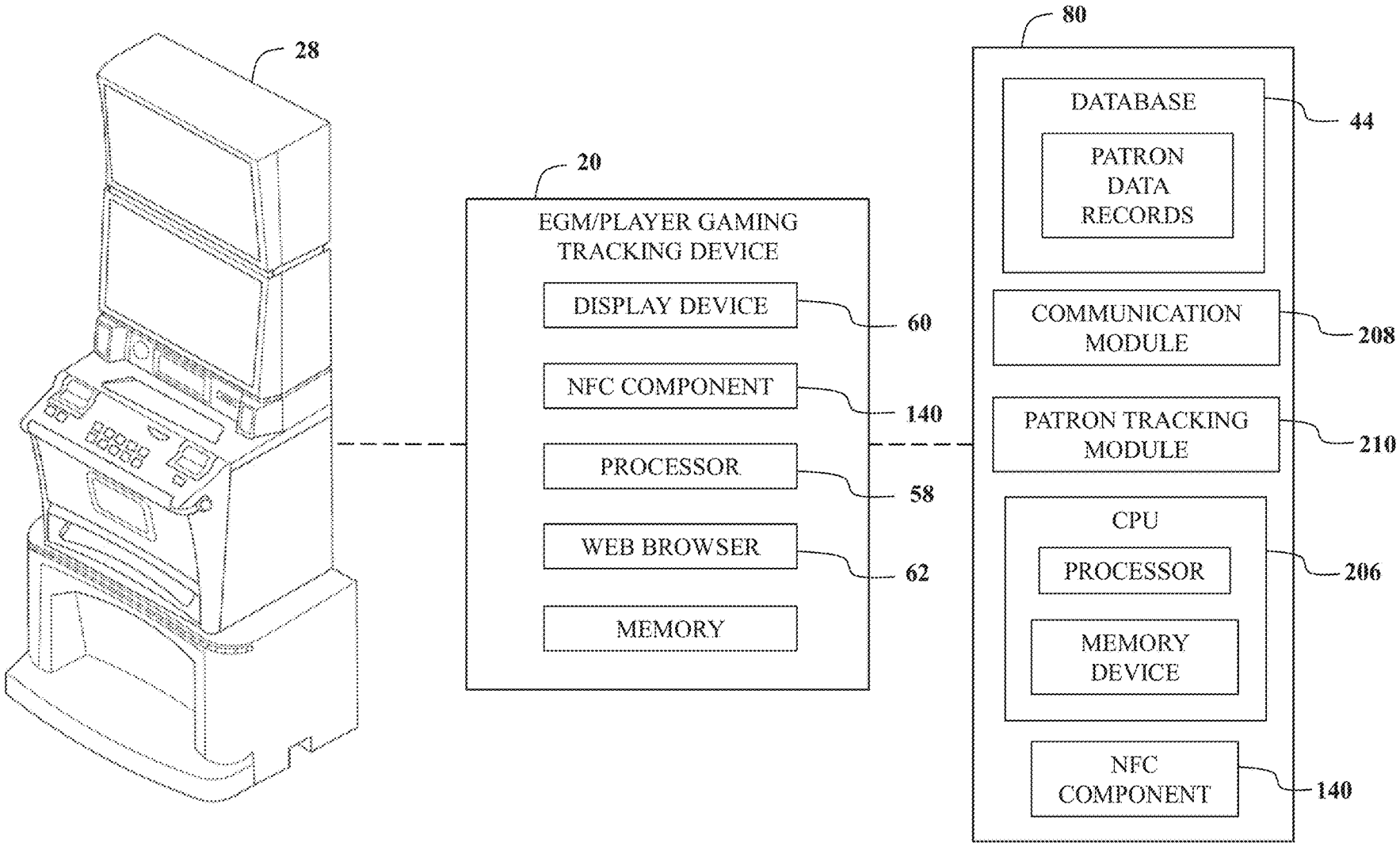

Illustrated in FIGS. 8-9, the patron tracking module 210 is configured to receive player tracking information from one or more player gaming tracking devices 20 and generate player tracking accounts for use in storing the information received from the player gaming tracking devices 20. For example, in one embodiment, the patron tracking module 210 is configured to generate and store a plurality of carded player tracking account records 212 (shown in FIGS. 9 and 26) in the database 44. Each carded player tracking account record 212 includes a player account ID 180 associated with a casino patron, a patron name, a birthdate, a unique player tracking ID 182 associated with a NFC component 140, address information associated with the casino patron including a corresponding postal code, and a PIN 214 associated with the player tracking ID 182 to allow access to the player account 212. Each carded player tracking account records 212 also includes player tracking data that includes information on the amount of wagers and type of games being played by the patron and/or an amount of goods and/or services being purchased by the patron. For example, shown in FIG. 10, each carded player tracking account records 212 may include one or more patron transaction records 216. Each patron transaction record is associated with a transaction being made by the corresponding patron. Each patron transaction record may include information that indicates a transaction being made by the patron such as, for example, a purchase being made at a POS terminal associated with the casino, an amount of wagers being placed with a slot machine, and/or an amount of wagers being placed at a table game.

During operation, the patron may enter player information at a player gaming tracking device 20 associated with a gaming machine 12 to initiate a gaming session to begin placing wagers on the games being provided by the gaming machine 12. For example, in one embodiment, the patron may log into the EGM 28 by being in a predetermined proximity to the EGM 28 with a blue light indicating an available EGM 28. Once the NFC reader 96 receives the NFC communication 138 from the mobile computing device 26, the EGM 28 determines the player tracking ID 182 from the NFC communication 138 and then requests from the patron the corresponding PIN 214. The patron may be triggered to enter the corresponding PIN 214 in order to securely access the associated player account 212. Once the EGM 28 has received a correct PIN corresponding to the player tracking ID 182, the patron may receive access to the player account 212 associated with the player tracking ID 182. In another embodiment, the player may initiate a gaming session at a gaming table, and allow a casino employee to enter player information into a player gaming tracking device 20 and/or mobile computing device 26 associated with the gaming table. In addition, while the patron is still logged into the EGM 28, the employee may be able to use the employee tracking ID 182 (also known as player tracking ID) to be read by the NFC reader 96 and override the patron using the EGM 28 and perform functions while the patron is still logged into the EGM 28. The patron's play may be paused or continued while the employee is currently logged into the same EGM 28.

Upon receiving the player information, the patron tracking module 210 may access the database 44 to identify and retrieve a carded player tracking account records 212 associated with the player information including the unique patron ID 182 (shown in FIG. 10). The patron tracking module 210 may then generate a patron transaction record 216 including information associated with the gaming session including, but not limited to, a unique session ID 218, a date of the gaming session, a start time, and a game type. Upon completion of the gaming session, the player gaming tracking device 20 and/or patron tracking module 210 receives information associated with amount of wagers being placed by the player during the gaming session and updates the patron transaction record 216 to include an end time to the gaming session, and a total amount of wagers being placed.

In one embodiment, the database 44 may also include an action event record list 220 (shown in FIG. 11) that includes a plurality of action event records 222. Each action event record 222 may include a triggering event 224, action event data 226, and the action event 228. The system 10 may initiate the action event 228 once the action event is triggered by the triggering event 224. Once the action event is triggered, the player gaming tracking device 20 may transmit the action event 228. For example, if the NFC reader 96 receives a player tracking ID 182 from a NFC component 140, the player gaming tracking device 20 may request the corresponding player account 212 from the database 44. The player gaming tracking device 20 may be triggered to request from the player the corresponding PIN 214 that is associated with the player account 212 and the player tracking ID 182. Once the player gaming tracking 20 device has verified the PIN 214 with the player tracking ID 182, the player may receive access to the associated player account 212. Action event data 226 includes information and data including, but is not limited to, determining corresponding PIN(s) with player tracking ID(s), transmitting associated player accounts with successful log ins, and/or determining whether a second player/user is allowed to access the EGM 28 while a current player is logged into the EGM 28. As shown in FIG. 11, the action event data 226 description may include data associated with the corresponding action record. For example, in one embodiment, the action event data, Action004, allows a player tracking ID 182 access to the EGM 28 while a different player is using the EGM 28, as long as the second player ID has a higher priority than the current player that is logged in. The second player is usually a gaming employee that is tracking data, awarding a jackpot, etc. The triggering events may include, but are not limited to, receiving a correct PIN, receiving a green light and or red light on the NFC reader, and/or receiving player tracking ID(s). Once the system 10 initiates the triggering event 224, the triggering event triggers the corresponding action event 228, which will send the action event data 226 to the corresponding server.

The database 44 may also include a player action record list 230 (shown in FIG. 12) that includes a plurality of player action records 232 that are associated with a plurality of players. Each player action record 232 includes the player transaction record 216 associated with the corresponding player tracking ID 182, the action record ID 222, the triggering event 224, the action event data 226, and the action event 228. In addition, the player action record 232 may also include information transmitted to the system 10 including data and information to be sent with by the player gaming tracking device 20 and/or the mobile computing device 26 associated with the corresponding player tracking ID 182 and/or API information associated with the corresponding mobile computing device 26.

Figure 13:
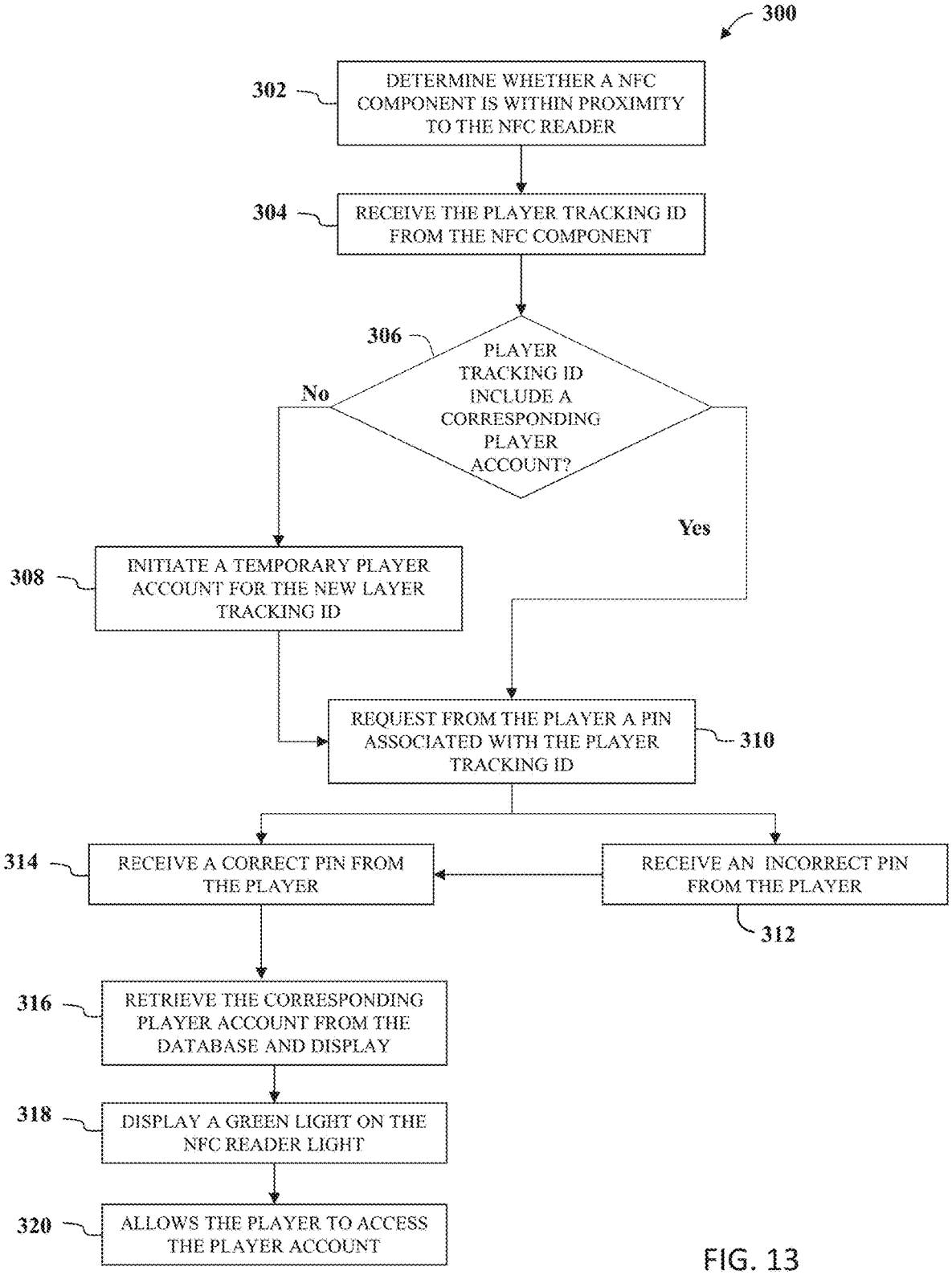
FIG. 13 is a flowchart of an algorithm method that may be implemented by the gaming system shown in FIG. 1 for providing gaming property services to a player, according to an embodiment of the present invention.

FIG. 13 illustrates a flowchart of algorithm method 300 that may be implemented by the host computer 80 for use in generating information that may be used to provide gaming property services to a casino patron. The method 300 includes a plurality of steps. Each method step may be performed independently of, or in combination with, other method steps. Portions of the method 300 may be performed by any one of, or any combination of, the components of the system 10.

In method step 302, the system 10 determines whether the NFC component 140 of the mobile computing device 26 (or NFC enabled card) is within proximity to the NFC reader 96 of the EGM 28. If the NFC reader 96 receives a bad read of the NFC component 140, the NFC reader light 142 may display a red color.

In method step 304, the system 10 receives the player tracking ID 182 from the NFC component 140 (from the mobile computing device 26 or the NFC enabled card).

In method step 306, the system 10 determines whether the database includes a corresponding player account 212 with the player tracking ID 182. If the player tracking ID 182 does not include a corresponding player account 212, in method step 308, the system 10 may initiate a temporary player account for the new player tracking ID 182. In method step 310, the system 10 may request from the player a PIN 214 associated with the player tracking ID 182 to allow the player to access the player tracking account 180.

In method step 312, the system 10 receives an incorrect PIN 214 from the player forcing method step 310 to repeat until the system 10 receives a correct PIN.

In method step 314, the system 10 receives a correct PIN 214 and in method step 316, retrieves the corresponding player account 212 from the database 44 to display on the player gaming tracking device 20. In addition, in method step 318, once the correct PIN is received the NFC reader light may light up green indicating a good tap-in of the NFC component 140.

In method step 320, the system 10 allows the player tracking ID and corresponding player access to the player account.

In method step 322, the player may retrieve a plurality of information from the player tracking account for the player's use.

In method step 324, the system 10 enables a temporary account to access the information collected from the previous play by setting up a new PIN for the temporary account creating a new player account. By setting up a new account, in method step 326, the temporary account is transformed into a new player account 212. In order to verify the temporary account, the player may repeat method steps 302-314 to set up the new player account with the new PIN number.

In method step 328, the system 10 receives a tap-off or log-off from the NFC component 140 initiating the player tracking ID 182 to be logged off. In method step 330, the system 10 transmits the information from the players' transactions to the database 44 to be stored.

In method 332, a second user may log-in to the EGM 28 while another player is currently logged into the EGM 28. In method step 334, the system 10 receives a second player tracking ID within the proximity to the NFC reader 96. In method step 336, the system 10 repeats method steps 302-314 to verify the second player tracking ID. In method step 338, the system 10 determines whether the second player tracking ID has a higher priority than the first player tracking ID. For example, if the second player tracking ID is associated with a gaming employee, the second player tracking ID may log-in and award the first player tracking ID a received jackpot award. In method step 340, the system 10 receives a tap-off or log-off from the NFC component 140 initiating either the first player tracking ID or the second player tracking ID to be logged of from the player gaming tracking device 20. In method step 342, the system 10 transmits the transaction information from the first and second player tracking ID to the database 44 to be stored.

In another embodiment, the system 10 may use Tap-on/Tap-off technology for logging in and logging out versus the traditional mag-stripe encoded cards. In addition, Twin Towns may use Tap-on/Tap-off technology for logging in and logging out versus the traditional mag-stripe encoded cards.

The SYNKROS player tracking required changes includes a NFC/cell phone reader support tap-on for "card-in", adding lights around the reader to indicate successful login to the player tracking account, a NFC/cell phone reader support tap-off for "card-out", and adding a log-off button to the attract players to the player screens. If there are no credits on game after 30 seconds, the system may automatically log the player off of the EGM 28. In addition, all other player interactions with the system remain the same. For example, Redeem Free Play, Download CWA fund will still require a player PIN. The transaction flow remains the same as is currently implemented.

The SYNKROS workstation required changes includes a NFC/cell phone supported reader at the club to read cards/cell phones, and a NFC/cell phone supported encoder (data storage in the database if the NFC/cellphone number is different than the current magnetic card). In addition, both magnetic cards and NFC/cell phones must be supported simultaneously.

The SYNKROS Android™ and Apple™ plugin. The system includes a plugin for Android™ to allow a player to store their SYNKROS card number so their phone can broadcast the card number using the phone's NFC component and be used to tap-in/tap-off versus an NFC encoded card. Currently, Apple IOS™, Apple™ SDK doesn't allow developer's access to the NFC as it is used for the proprietary PayPal™. Therefore, for Apple™ phones the system includes a NFC tag (sticker) that can be put on an Apple™ phone so the tag may function like the Android™ phone.

Figure 14:
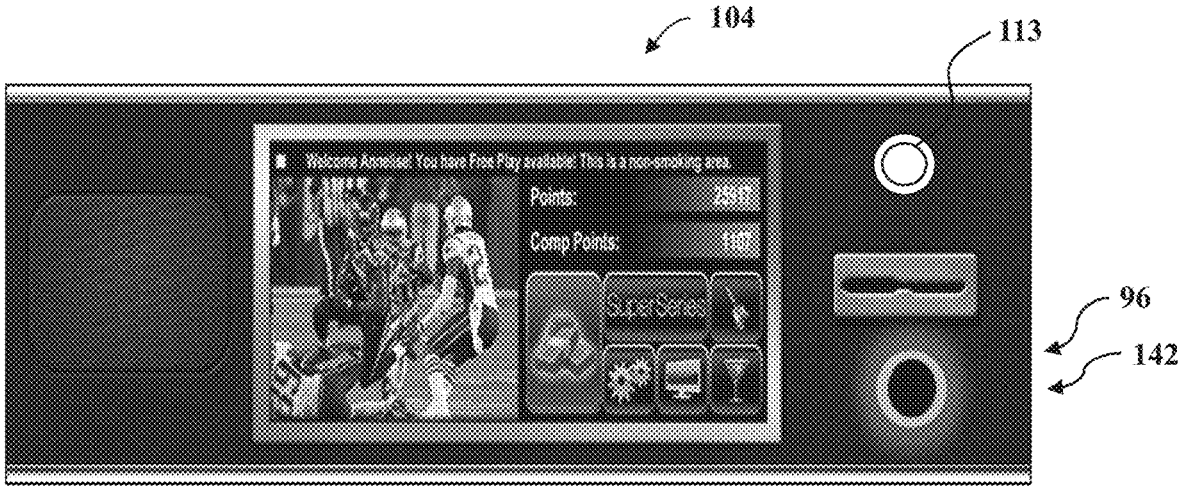
FIGS. 14-19 are graphical displays that may be displayed using the gaming system shown in FIG. 1, according to an embodiment of the present invention.
Figure 15:
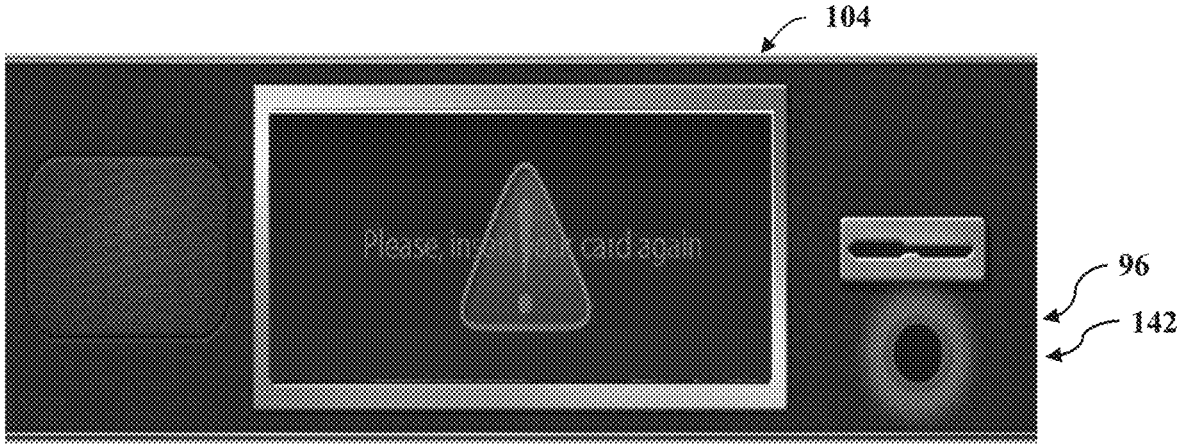
Figure 16:
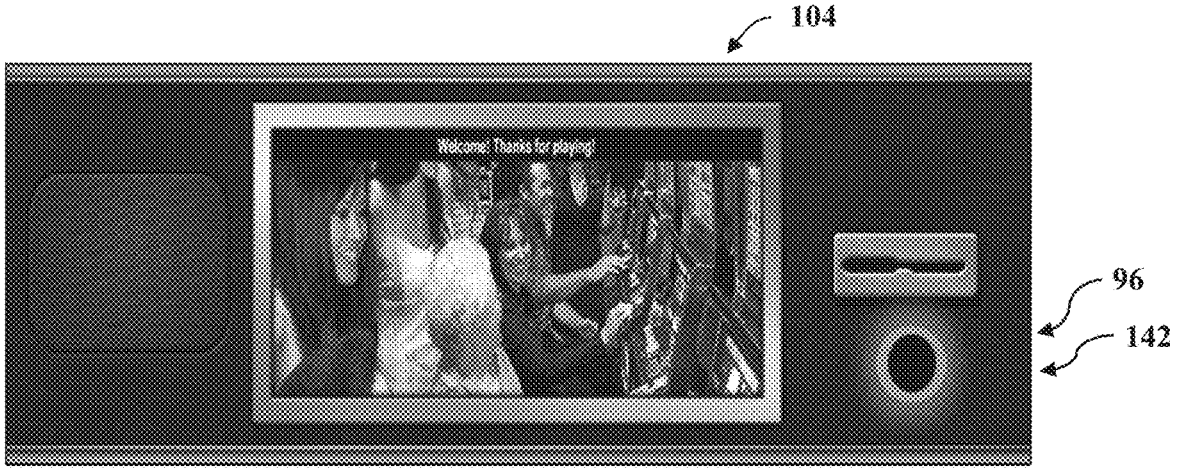
Figure 17:
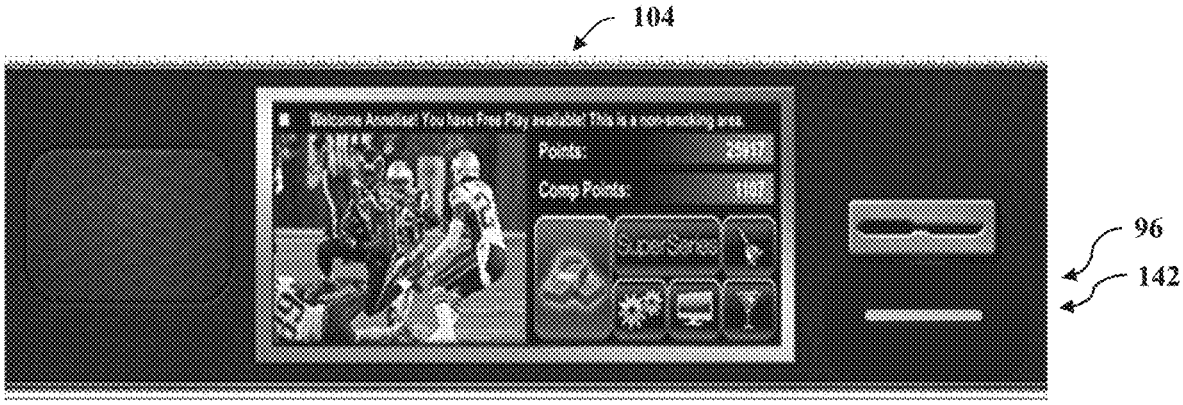
Figure 18:
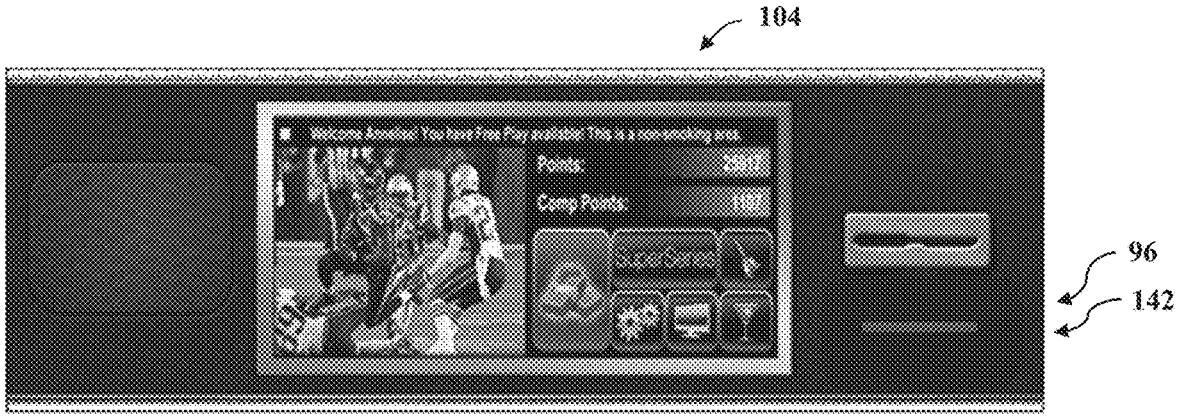
Figure 19:
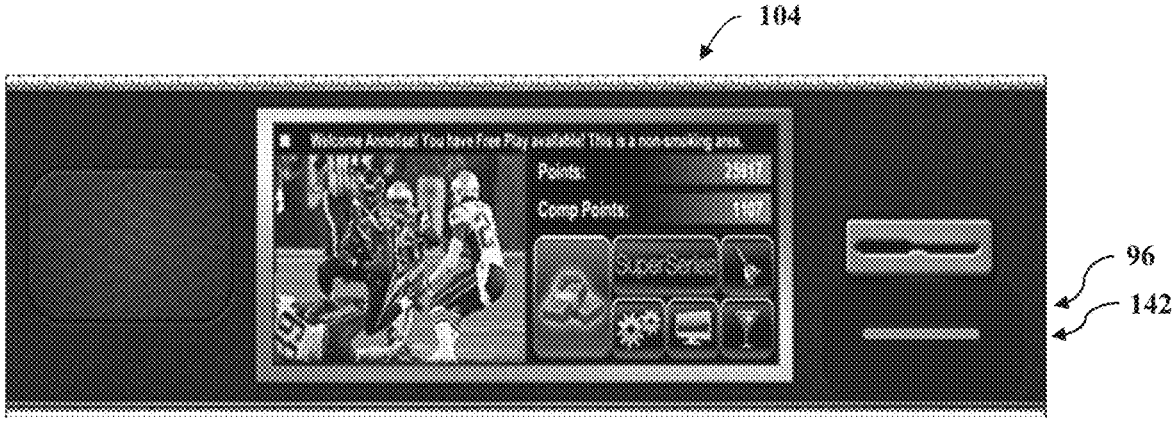

The SYNKROS player tracking required changes include an NFC/cell phone reader support tap-on for "card-in", NFC card or cellphone NFC read will use the SYNKROS card number to log the player into SYNKROS. The system includes lights around the reader 96 to indicate successful login to the player tracking account. Depending on the NFC reader, the antenna needs to be in the center of the NFC external mounting. It may also be possible (after testing) to add a plastic Lexan over black portion of the NFC external mount with either a "character" like a smiley face, the casinos' logo or even the SYNKROS logo provided it does not interfere with the NFC reader. As shown in FIG. 14, a green LCD light ring 142 indicates a good card read or NFC Tap and launches the carded screen on the TTD/TTW. As shown in FIG. 15, a red LCD light ring 142 indicates a bad card read or NFC Tap and launches the "Please, insert your card again" message and/or a message and voice over to "Please try again" so it is generic. As shown in FIG. 16, a blue LCD light ring 142 indicates no card or NFC Tap and remains on the un-carded or attract screen. As shown in FIGS. 17-19, alternative lighting depending on the placement of the NFC antenna and interference from the lighting.

In addition, the NFC/cell phone reader supports tap-off for "card-out". The second NFC card or cell phone NFC read while the player is logged in (shown in FIG. 14) will result in activating the system card-out logic. That is, the player will be logged off SYNKROS and the resulting uncarded or attract screen will again be shown (shown in FIG. 16). In another embodiment, a log-off button is added to the player screens (shown in FIG. 14). If no credits are on the game after a predefined time period such as 30 seconds or 1 minute, the system may be automatically logs the player off. In one embodiment, the system 10 uses existing logic for "abandoned" card time-out with the new NFC card/NFC cellphone reader. That is, if the conditions for the abandoned card timer are reached, then the system 10 may force a card-out and return the TTD/TTW to the attract screen (shown in FIG. 16). In addition, all other player interactions will remain the same. For example, Redeem Free Play, Download CWA fund will still require a player PIN. The transaction flow remains the same as is currently implemented.

The SYNKROS workstation required changes includes a NFC/cell phone supported reader 96 at the club to read cards/cell phones. A NFC/cell phone supported encoder (data storage in the database if the NFC/cellphone number is different than the current magnetic card). In addition, both the magnetic cards and the NFC/cell phone must be supported simultaneously. In addition, the system 10 must be able to produce hybrid cards, i.e., magnetic stripe encoding and NFC encoding and must be able to produce NFC tags (stickers) to attach to cell phones.

The SYNKROS Android™ plugin. The system includes a plugin for Android™ phones to allow a player to add their SYNKROS card number so their phone can broadcast the card number using the phone's NFC and be used to tap-in/tap-off versus an NFC encoded card. In addition, currently, Apple™ IOS doesn't allow this so a NFC tag (sticker) must be used.

The plugin may also be provided to 3rd party software developers to include in the player mobile application to make the phone act like an NFC encoded card.

Currently, Apple IOS™, Apple™ doesn't allow developer's access to the NFC as it is used for the proprietary PayPal™. Therefore, for the Apple™ phone the system may include a NFC tag (sticker) that can be put on an Apple™ phone so it can function like Android™ phone. Player's club must be able to produce these NFC tags (stickers) so customers can attach them to the Apple™ phones. For casinos that don't have a phone app for the specific casino, the stickers may also work on the Android™ phone (or existing player's magstripe only cards).

The SYNKROS service bus (SSB) required changes. SSB is configured to accept the NFC number from Kiosks, POS, other 3rd party systems (data storage in the database, refer to SYNKROS workstation Required Changes). The SSB is configured to accept creation/updates to the club membership fields stored in SYNKROS.

The SYNKROS Kiosk required changes includes allowing Atrient™ (or another Kiosk vendor) to produce compatible NFC encoded cards for player enrollment. Atrient™ (or another Kiosk vendor) sends the NFC number via the SSB to enroll the player. The system allows Atrient™ (or another Kiosk vendor) access to update fields that control club membership via the SSB.

In another embodiment, the system 10 may also use NFC enabled phones or NFC cards to set-up a temporary identification and track temporary players. The system may use a mobile application to sign up and get a temporary membership and track players on the temporary membership. Once the temporary player visits the player's club or a casino host to confirm the player's identity and the player meets the casino age requirement and are not self-barred/casino-barred, the system 10 converts the temporary player account into a SYNKROS account including all temporary play and base point accruals on the previously tracked ratings.

In addition, the system is configured to implement additional methods to sign-up player accounts from mobile phones using a URL/website and/or a downloaded app. The player may initially, not receive anything and may be a temporary player until activation. The NFC comes from the IOS/Android Phone or temporary NFC enabled card or device.

The NFC signal sends the player ID from the device (e.g. phone) to the NFC reader 96 in the player tracking unit. The NFC reader 96 in the player tracking unit, uses the ID to lookup the player (or temporary player account). The NFC reader 96 reads the NFC tag (card number) from the phone/app when it is close enough. Once the signal is sent and the player uses the mobile app to set up the temporary membership, the temporary membership is converted into a permanent/SYNKROS membership. For example, during the lookup, if the NFC tag (card number) is not found in SYNKROS, i.e., a new member, then the system 10 may ask the player if the player would like to sign up as a temporary member. The Player tracking (Synkbox embedded hardware) may communicate to the database to create a temporary player card for the player. The player then would need to go to the player club area to complete their membership and show a valid ID (over 18/21 years of age). Alternatively, the player could enter their information on the True-Time Display (Picture-in-Picture) at the EGM, but would still have to have a casino employee verify age and the player identity to convert the temporary player account to a permanent player account.

In addition, the SYNKROS club form (versus having to purchase a $4,000 NFC printer) sends the NFC signal to "save information" and avoid a $4,000 NFC printer to an NFC Android™ phone and associates a pre-print NFC label (to attach on iPhones™ or player mag stripe cards) so both iPhones™ and mag stripe cards can be used for NFC player tracking. In addition, the NFC information is saved on the phone as an NFC tag.

The Employee NFC functions include allowing the system 10 to not have to take the player card out for a payout (i.e., traditionally you had to remove the player's card, the card in as the employee). In addition, with an NFC reader at the slot, the NFC reader can enable the employee to "card-in" to do functions while the players are still carded in.

The awards given through NFC include allowing the player to enter a pin 214 to accept the award (anonymous Bonusing to a temp NFC account) and/or access to pre-loaded NFC cards with cash for cashless system (anonymous cashless wagering).

In addition, the NFC device includes adding a motion detector for Sign-off on the player tracking bracket (i.e. motion detector, camera, range/proximity).

The player uses the mobile computing device 26, or the phone, (with the ability to send an NFC ID/tag) to log into the gaming machine for convenience so the player doesn't have to remember to use the card. For small club/pubs route (each with 5-10 machines), the small clubs may not want to print or use cards.

In addition, for security, the PIN number is used as a secondary security measure. The player must have the phone and know the PIN to access the player account 212. The information being sent through the NFC includes the player account 212. All banking information is handled via servers and services once the player is identified with the card number (player tracking ID 182) and the PIN is entered.

FIGS. 21-25 illustrate flowcharts of algorithm methods 400, 500, 600, 700, and 800 that may be implemented by the casino management server system 11 for use in generating un-carded anonymous player tracking accounts for tracking game play of un-carded anonymous players and for generating bonus award tables that may be used to provide system-based bonus awards to anonymous players.

Figure 31:
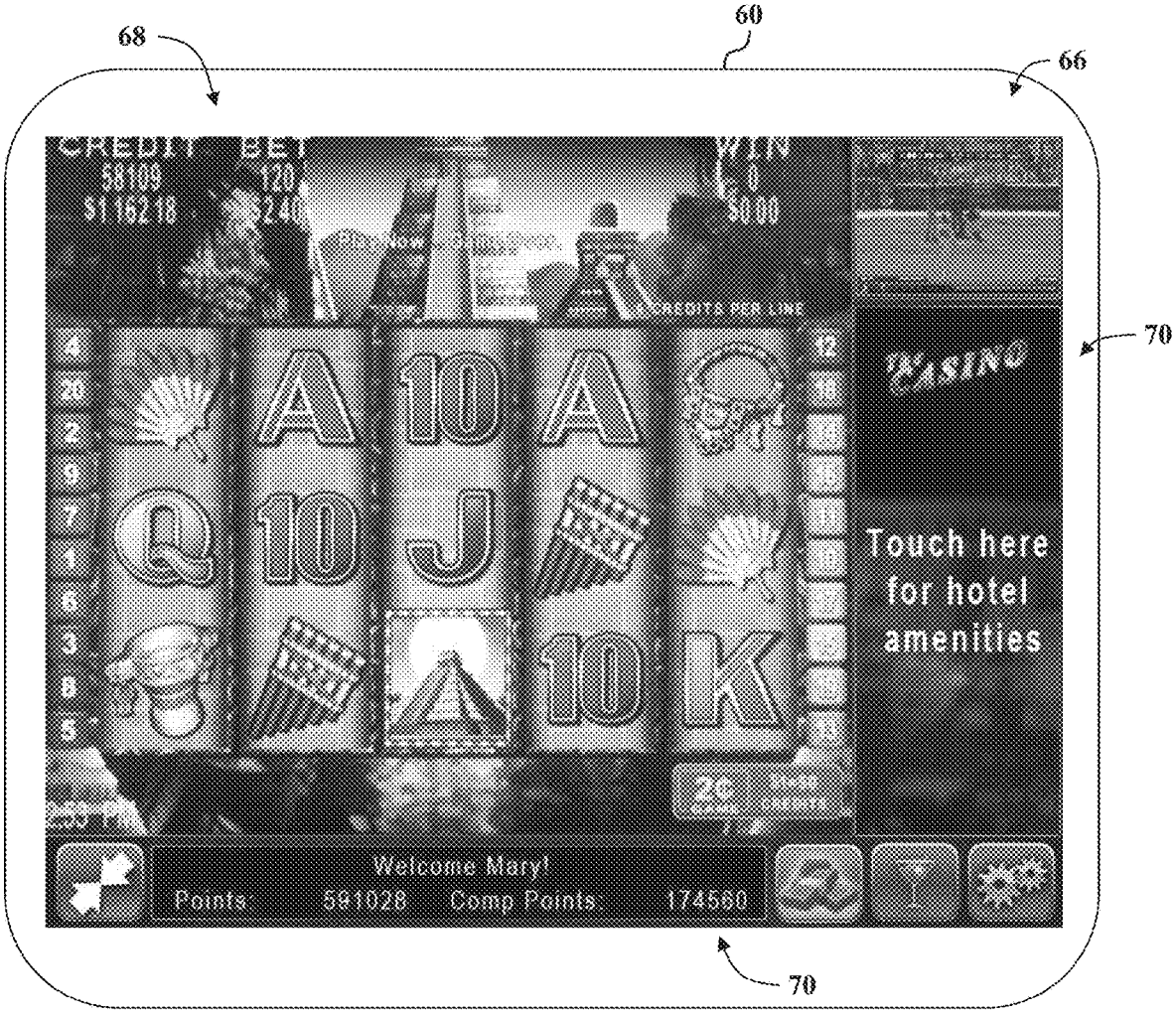
FIGS. 31-36 are graphical displays that may be displayed using the system shown in FIGS. 1 and 20, according to an embodiment of the present invention.
Figure 32:
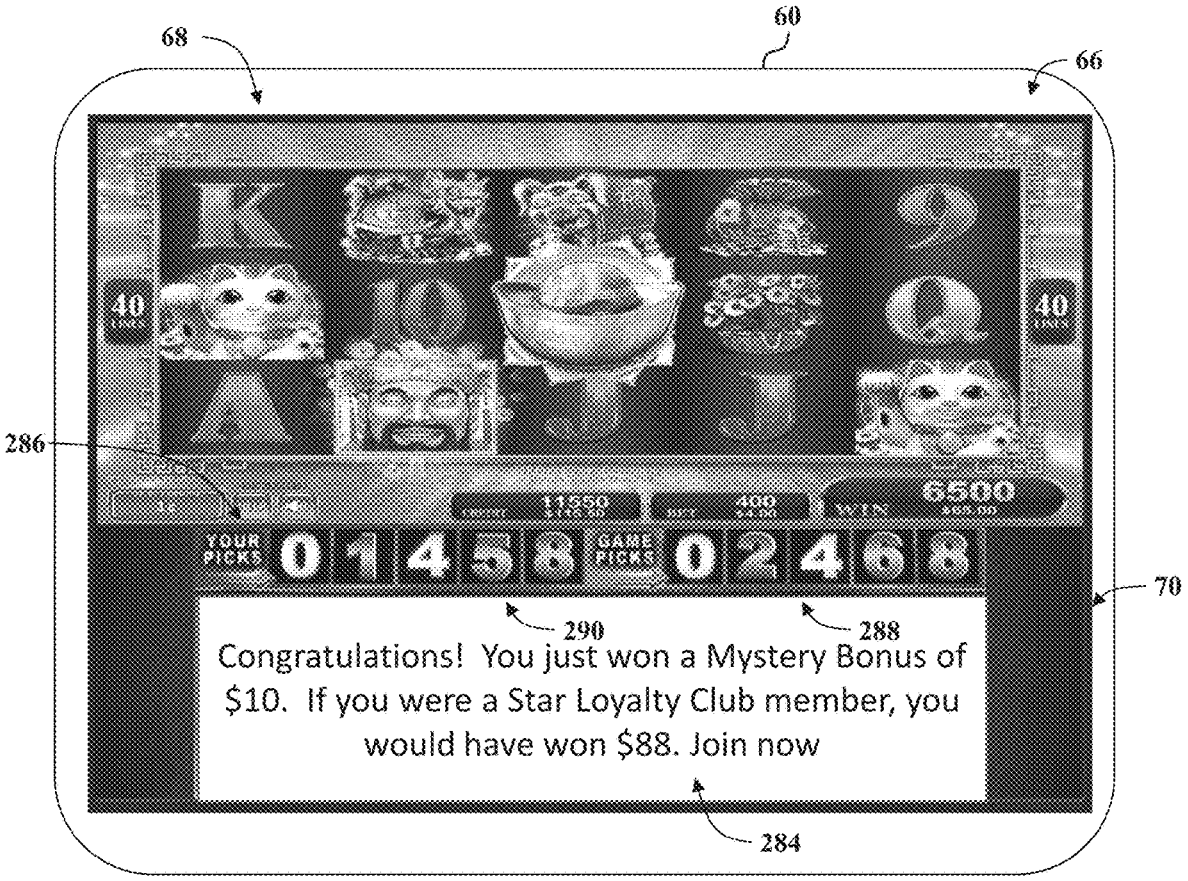

FIGS. 26-30 illustrate exemplary data files that are generated by the casino management server system 11 for use in providing system-based bonus awards to the anonymous players. FIGS. 31-32 illustrate graphical user interfaces that are generated by the casino management server system 11 and displayed on corresponding gaming devices 12 to display bonus award features and bonus awards to casino patrons, and FIGS. 33-36 illustrate various webpages that are displayed by the casino management server system 11 to enable a casino operator to establish bonus award tables and triggering events for use by the casino management server system 11 for providing system-based bonus award features and bonus awards to casino patrons. The methods 400, 500, 600, 700, and 800 include a plurality of steps of each algorithm. Each method step may be performed independently of, or in combination with, other method steps. Portions of the methods 400, 500, 600, 700, and 800 may be performed by any one of, or any combination of, the components of the system 10.

Figure 21:
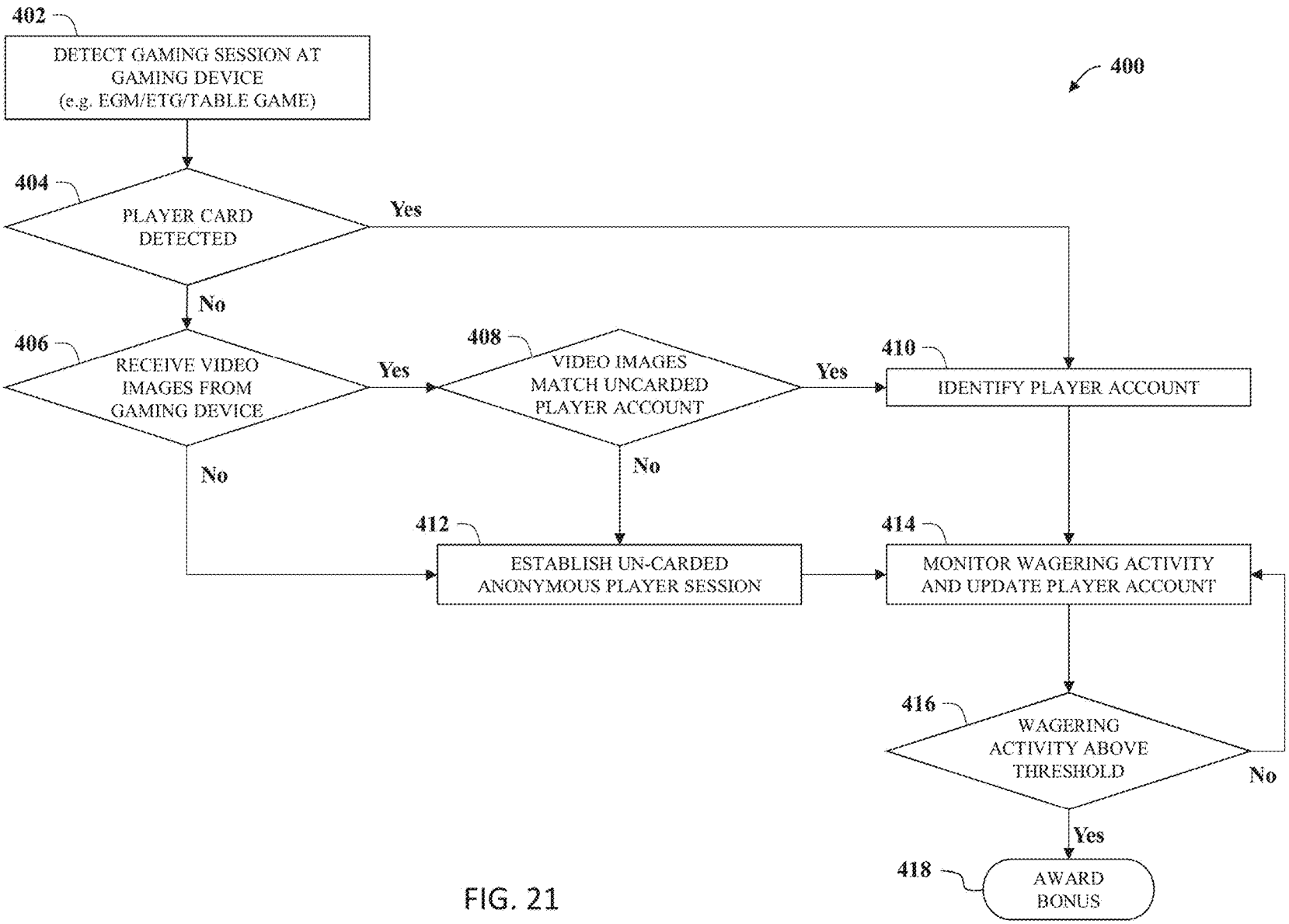
FIGS. 21-25 are flowcharts of algorithm methods that may be implemented by the gaming system shown in FIGS. 1 and 20, according to an embodiment of the present invention.

Referring to FIG. 21, in the illustrated embodiment, the casino management server system 11 implements algorithm method 400 to establish an un-carded anonymous player wagering session and/or account 250 (shown in FIG. 27) during a gaming session being initiated by a casino patron at a gaming device. The un-carded anonymous player wagering session and/or account 250 may be used by the casino management server system 11 to track wagering activity associated with an unknown anonymous casino patron that does not have a corresponding carded player tracking account 212, or has not been associated with a corresponding carded player tracking account 212 by the casino management server system 11. The casino management server system 11 uses the un-carded anonymous player wagering session and/or account 250 to track wagering activity and to allow the casino management server system 11 to provide system-based bonus awards to the unknown anonymous player via the corresponding gaming device 12. For example, in one embodiment, the casino management server system 11 may be programmed to provide bonus awards including gaming credits that are downloaded to the credit meter of the corresponding gaming machine for use in placing wagers on the games provided by the gaming machines. In one embodiment, methods 400, 500, 600, 700, and 800 are executed by the player management system 18. In other embodiments, the methods 400, 500, 600, 700, and 800, or portions thereof, may be executed by the player management system 18, the gaming property management system 14, or table games system via a host workstation 81, and/or the multipurpose EGM/player gaming tracking device 20.

When executing method 400, the casino management server is programmed to detect a gaming session being initiated by a corresponding player at a corresponding gaming device, determine whether a carded player account is associated with the player, and generate a corresponding un-carded anonymous player wagering session and/or account associated with the gaming session upon determining a carded player account is not associated with the corresponding player. The corresponding un-carded anonymous player wagering session and/or account generated by the casino management server includes a gaming machine ID associated with the corresponding gaming machine, a unique gaming session ID, and wagering information associated with the detected gaming session.

For example, in one embodiment, in method step 402, a processor of the casino management server system 11 detects a gaming session being initiated at a gaming device. For example, the casino management server may detect a wager being placed on a slot game being displayed by a gaming machine 28.

In method step 404, the casino management server processor determines whether a player card has been detected. For example, the processor may detect a physical player card being inserted into the card reader 108 of a player tracking terminal 94 associated with the gaming machine 28, and/or receive a signal from the player tracking terminal 94 indicated in a player tracking card ID has been received by the player tracking terminal 94. In one embodiment, the casino management server processor may receive a signal from the player tracking terminal 94 indicating a player tracking card ID has been received from the near field communication (NFC) reader 96.

If the casino management server processor determines that a player tracking card ID has been received by the player tracking terminal 94, the casino management server processor proceed to method step 410 and accesses the carded player tracking account records 212 to identify a carded player tracking account record matching in the received player tracking card ID. The casino management server processor then proceeds to method step 414 and monitors the wagering activity associated with the detected gaming session and updates the carded player tracking account record to include the monitored wagering activity. For example, the casino management server processor may be programmed to detect the gaming session being initiated by the corresponding player at the corresponding gaming machine, receive a patron card ID from a player tracking device associated with the corresponding gaming machine, and identify a corresponding carded player account associated with the corresponding player based on the received patron card ID.

If the casino management server processor does not received a player tracking card ID from the player tracking terminal 94 and/or the gaming machine 28, the casino management server processor implements method step 406 to request and receive video images from the gaming device. If the video images are received from the gaming device, the casino management server implements method step 408 to determine whether the received video images match a known un-carded anonymous player account. For example, upon receiving the video images from a gaming device, the casino management server processor accesses existing un-carded anonymous player account records to identify an un-carded anonymous player tracking account record matching in the received video image. If the received video images match an existing image of an un-carded or carded player, the casino management server proceeds to method step 410 to identify the matching player account and to method step 414 to monitor the wagering activity of the gaming session.

If the casino management server does not identify a matching existing un-carded anonymous player account records at step 408, or does not receive video image data from the gaming device at step 406, the casino management server processor implements method step 412 and generates an un-carded anonymous player wagering sessions and/or account 250 (shown in FIG. 27). For example, in one embodiment, if a video image is not received from the gaming device, an un-carded anonymous wagering session is used in tracking wagering activity during the gaming session and to provide bonus awards to the unknown anonymous player during the gaming session. In the illustrated embodiment, the casino management server processor generates the un-carded anonymous player wagering session and/or account 250 to include a temporary player account ID 252, a gaming session ID 254 associated with the current gaming session, and a gaming machine ID 256 associated with the corresponding gaming machine 28. In one embodiment, the casino management server processor may also generate the un-carded anonymous player wagering session to include wagering information 258 associated with the monitored wagering activity associated with the current gaming session.

In one embodiment, the casino management server processor receives a video image of the player from a video image sensor associated with the corresponding gaming machine, and generates the corresponding un-carded anonymous player wagering sessions and/or account including data associated with the video image of the player. For example, the casino management server processor may also receive a video image of the anonymous player from the video image capture system 111 mounted on the corresponding player tracking terminal 94, and update the un-carded anonymous player account 250 to include image data 260 associated with the received video images. The casino management server processor may be programmed to initiate a facial recognition program to identify the anonymous player, and/or assign the anonymous player account a digital signature of the face captured.

In the illustrated embodiment, the casino management server system 11 include a memory device for storing a plurality of carded player accounts 212 and a plurality of un-carded anonymous player wagering sessions and/or accounts 250. Each carded player account 212 and un-carded anonymous player account 250 includes an account ID 180, 252. In addition, each carded player account 212 includes a corresponding unique patron card ID 182, and each un-carded anonymous player wagering session and/or account does not include a corresponding unique patron card ID.

In method step 414, the casino management server processor continues to monitor wagering activity during the gaming session and modify the un-carded anonymous player wagering session and/or account 250 to include the monitored wagering activity. In one embodiment, the casino management server processor may be programmed to assign an uncarded rating to the new un-carded anonymous player wagering session and/or account 250 for use in providing bonus awards 419 for anonymous player bonusing. For example, the casino management server processor may be programmed to add additional play criteria metrics to target repeat anonymous players that may be recognized using the digital signature of the facial image data stored in the un-carded anonymous player wager account 250. In one embodiment, the casino management server processor is programmed to detect a subsequent gaming session being initiated by the player, receive video images of the player from the corresponding gaming machine, identify the corresponding un-carded anonymous player wager account based on the received receive video images of the player, and modify the identified un-carded anonymous player account to include information associated with the subsequent gaming session. In addition, the casino management server processor may be programmed to implement anti-money laundering/bank secrecy act (AML/BSA) compliance procedures using the un-carded anonymous player wager account 250. For example, the casino management server processor may be programmed to detect suspicious wagering activity and initiate suspicious activity reporting, including, for cash-in or cash-out transactions that exceed $10,000 in a given gaming day, automate the suspicious activity reporting by supplying the anonymous image captured on the account along with the cash-in/cash-out transactions that total over $10,000 in a given gaming day.

In method step 416, the casino management server processor determines whether the monitored wagering activity of the gaming session meets or exceeds a threshold wagering activity. For example, the threshold wagering activity may include, but is not limited to, a minimum total wager amount, a minimum wager amount, a predefined period of time during the gaming session, a predefined period of time, a predefined time of day, and/or any suitable measurable activity associated with the gaming session and/or gaming device.

In method step 418, in one embodiment, the casino management server may provide the bonus award value to carded and un-carded players upon determining the monitored wagering activity of the gaming session meets or exceeds a threshold wagering activity.

Referring to FIGS. 22-25, in the illustrated embodiment, the casino management server system 11 implements algorithm methods 500, 600, 700, 800 to initiate a bonus award feature that may be use to provide system-based bonus awards to the unknown anonymous player that has initiated an active gaming session at a gaming machine. For example, the casino management server processor may be programmed to generate a plurality of bonus award tables 262, 264, 266 (shown in FIGS. 28-30) that include a plurality of system bonus awards 268 associated with the bonus award features. Each bonus award may include a first award value 270 that is associated with a carded player account 212 and a second award value 272 that is associated with an un-carded anonymous player wagering session and/or account 250. In general, the first award value is greater than the second award value. In addition, the first award value 270 associated with the carded player account 212 may be different than the second award value 272 associated with the un-carded anonymous player wagering session and/or account 250. For example, the first award value 270 may include bonus points and/or non-cashable gaming credits, and the second award value 272 include downloadable cashable gaming credits.

By using bonus award tables 262, 264, 266 that includes different bonus awards associated with carded player accounts 212 and un-carded anonymous player wagering sessions and/or accounts 250, the casino management server system 11 enables a casino operator to implement a bonus award feature that may be used to award carded and un-carded players using the same award criteria. For example, the bonus award tables 262, 264, 266 may be used to implement bonus award features having award criteria associated with predefined wagering activity, predefined period of time or time of day, randomly selected gaming machines, and/or any suitable system award criteria.

Figure 33:
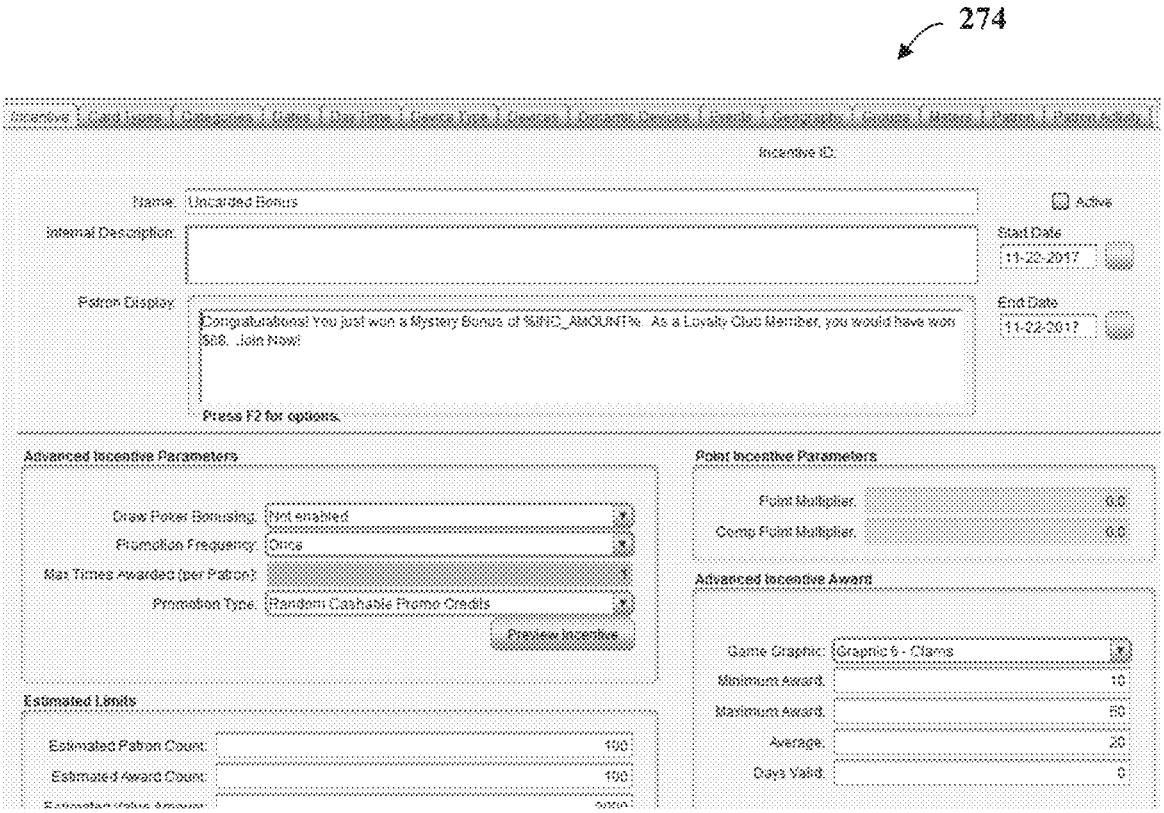

For example, referring to FIGS. 28 and 33, in one embodiment, the casino management server may display an advanced incentives bonus set-up webpage 274 for use in generated an advanced incentives bonus award table 262 that may be used to provide system-based bonus awards to carded player accounts 212 and un-carded anonymous player wagering sessions and/or accounts 250. The advanced incentives bonus award table 262 include a plurality of bonus awards 268 associated with a plurality of wagering activity trigger values 276 that may be established by a casino operator with selections made via the advanced incentives bonus set-up webpage 274. For example, each wagering activity trigger value 276 may be associated with a wagering activity occurring during a gaming session including, for example, a length of a gaming session, an average amount wagered during a gaming session, an total amount wagered during the gaming session, and/or any suitable trigger event that may be associated with wagering activity occurring during a gaming session.

In the illustrated embodiment, the advanced incentives bonus set-up webpage 274 includes a patron display field to allow operators to input a specific message to be displayed on the gaming machine and/or patron tracking device, when a bonus award is provided. In addition, the advanced incentives bonus set-up webpage 274 may include an advance incentives parameter field that allows the casino operator to define the wagering activity trigger values 276, the bonus award values associated with each wagering activity trigger value 276, and the amount of the first award value 270 associated with a carded player account 212 and the second award value 272 associated with a un-carded anonymous player wagering session and/or account 250. In addition, advanced incentives bonus set-up webpage 274 allows the casino operator to establish an Advanced Incentives™ bonus award feature including a new promotion type including EGM credits fix amount, a new promotion type (EGM credit random) min/max/average, an uncarded selected box which reduces criteria tabs to Date Time, Device Type, Devices, and a Modify Patron meters tab for single uncarded rating>Amount as a trigger.

Figure 34:
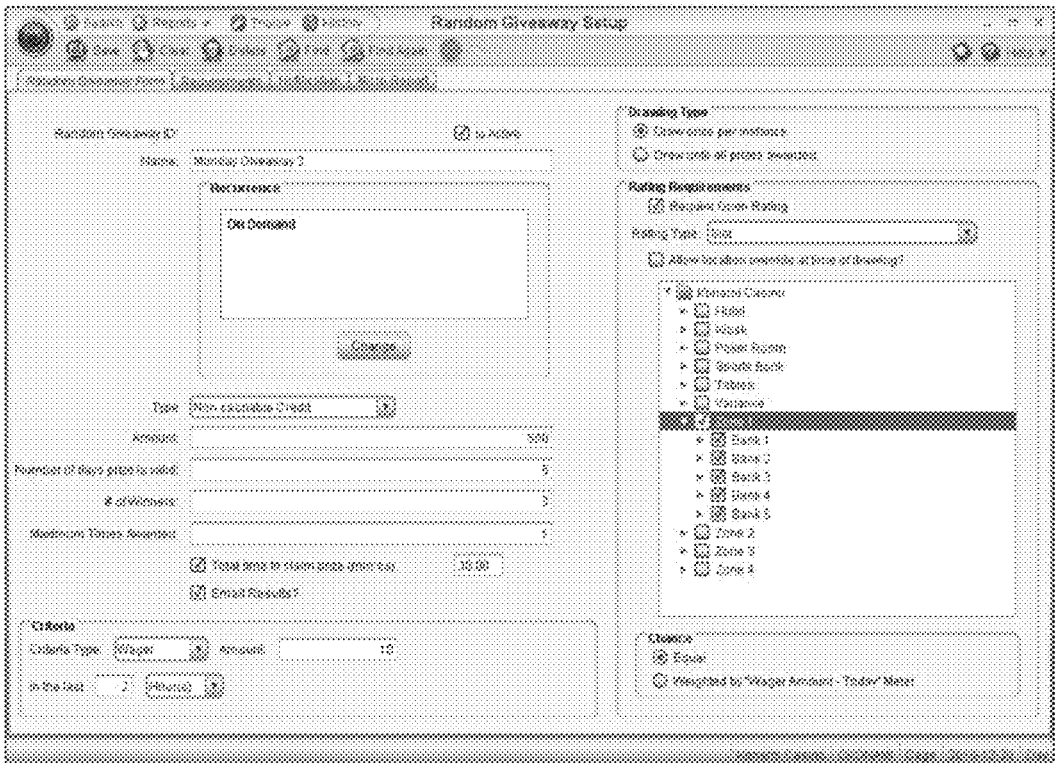
Figure 35:
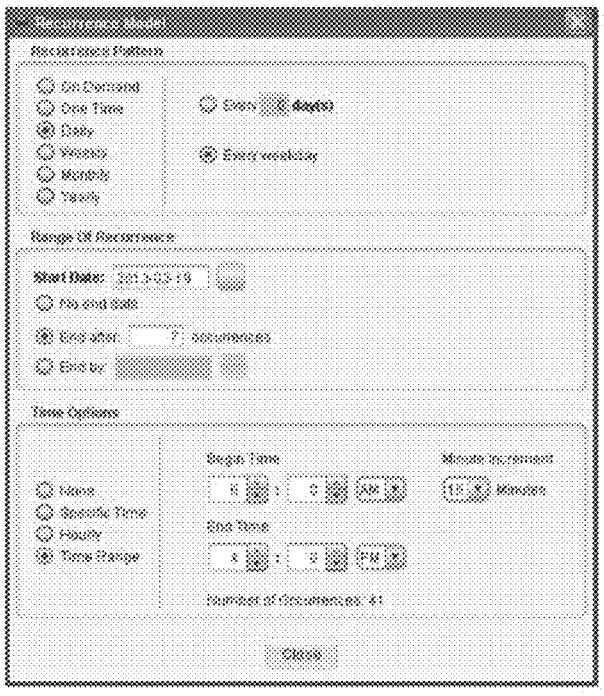

Referring to FIGS. 29 and 34-35, in one embodiment, the casino management server may display a random giveaway bonus set-up webpage 278 for use in generating a random bonus award table 264 that may be used to provide system-based bonus awards to carded player accounts 212 and un-carded anonymous player wagering sessions and/or accounts 250. The random bonus award table 264 may be used to provide system-based awards to randomly selected gaming machines. As shown in FIGS. 34-35, the random giveaway bonus set-up webpage 278 includes a criteria selection form that allows casino operators to criteria required to be included in the random award selection such as for example, minimum wagers made within a predefined period of time. In addition, the random giveaway bonus set-up webpage 278 allows the casino operator to establish different bonus awards associated with different areas, or zones of gaming machines within the casino, to allow the casino operator to provide a bonus award feature to specific areas of the casino floor at specific times. For example, as shown in FIG. 29, the random bonus award table 264 may include different bonus awards associated with different slot machine zones. The random giveaway bonus set-up webpage 278 also allows the casino operator to establish a reoccurrence of the bonus award feature, and shown in FIG. 35. In one embodiment, the random giveaway bonus set-up webpage 278 may be used to establish a Hot Seat™ random draw to include a new promotion type (EGM Credits), a new promotion type (EGM credit random) min/max/average, a new uncarded rating to rating type, and to allow for automated scheduling (recurrence).

Figure 36:
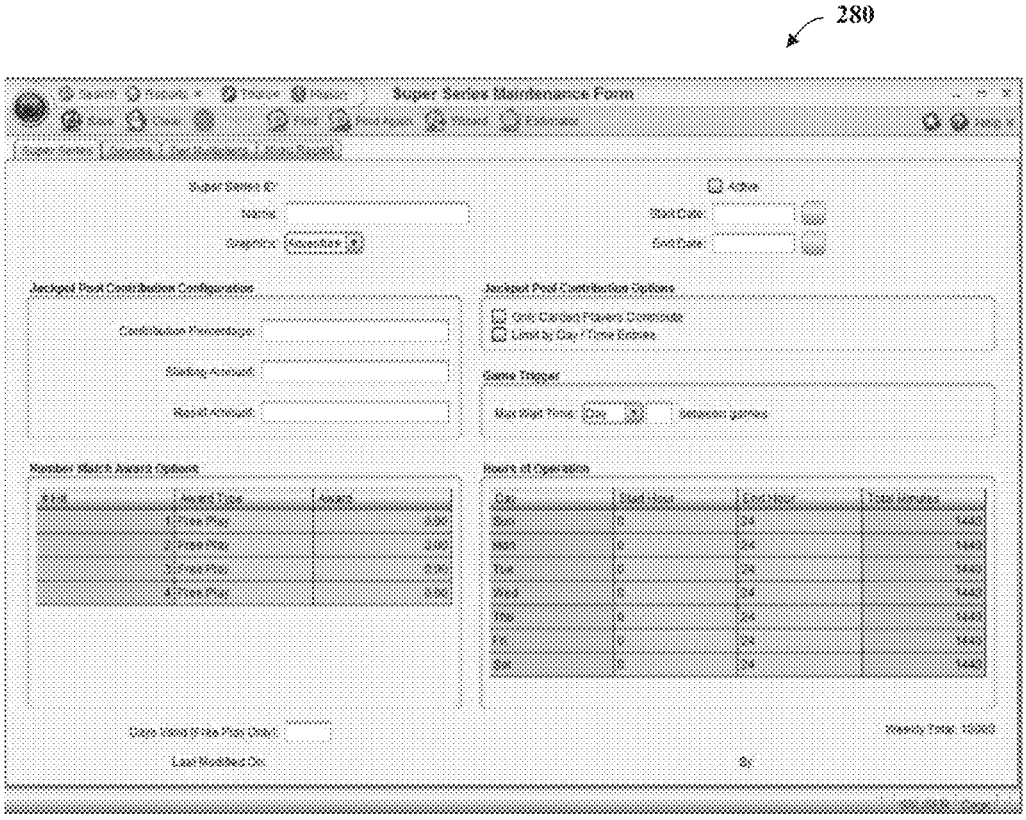

Referring to FIGS. 30 and 36, the casino management server may display a match game bonus set-up webpage 280 for use in generated an match game bonus award table 266 that may be used to provide system-based bonus awards to carded player accounts 212 and un-carded anonymous player wagering session and/or accounts 250. In general, during a match game bonus feature, the casino management server randomly selects numbers for a predefined set of numbers, and identifies carded player accounts 212 that have matching numbers. In this example, each carded player account 212 includes a subset 282 of numeric symbols, e.g. numbers selected from a finite range of numbers, (shown in FIG. 26) that have been preselected by the player when the carded player account 212 was initial established, or subsequently modified by the player. The casino management server then provides bonus awards to players based on the amount of matching numbers. However, because the un-carded anonymous player wagering sessions and/or accounts 250 are not established by the players, these un-carded anonymous player wagering sessions and/or accounts 250 do not have numbers that are selected by a player. As such, during a matching game initiated by the casino management server using un-carded anonymous player wagering sessions and/or accounts 250, the casino management server randomly selects another subset of numbers for each un-carded anonymous player wagering session and/or account 250, and provides bonus awards to gaming machines associated with the un-carded anonymous player wagering session and/or account 250 based on the amount of matching numbers. An example of a match game bonus feature that may be implemented by the casino management server is described in U.S. patent application Ser. No. 11/779,537 to Jeffrey George et al., now U.S. Pat. No. 8,727,854, filed Jul. 18, 2007, titled "System and Method for Operating a Matching Game in Conjunction with a Transaction on a Gaming Machine", which is incorporated herein by reference in its entirety.

As shown in FIG. 36, the match game bonus set-up webpage 280 includes a number match award option form that allows a casino operator to establish an amount of bonus awards associated with the number of matches of randomly selected numbers. For example, the casino operator for use the match game bonus set-up webpage 280 to generate the match game bonus award table 266 to include a different bonus award associated with each different amount of matching numbers. In addition, the match game bonus set-up webpage 280 allows the casino operator to establish a triggering frequency associated with the match game bonus feature.

In one embodiment, the match game bonus set-up webpage 280 may be used to establish a Super Series™ Bonusing Enhancements to include a new Award type column for uncarded (EGM Credits), and when the Super Series™ match game bonus feature is initiated, the system auto select 5 numbers for uncarded players, and awards uncarded players from an uncarded column, and awards carded players from the carded column with a 5 number match still wins the progressive (Locks the EGM).

Figure 22:
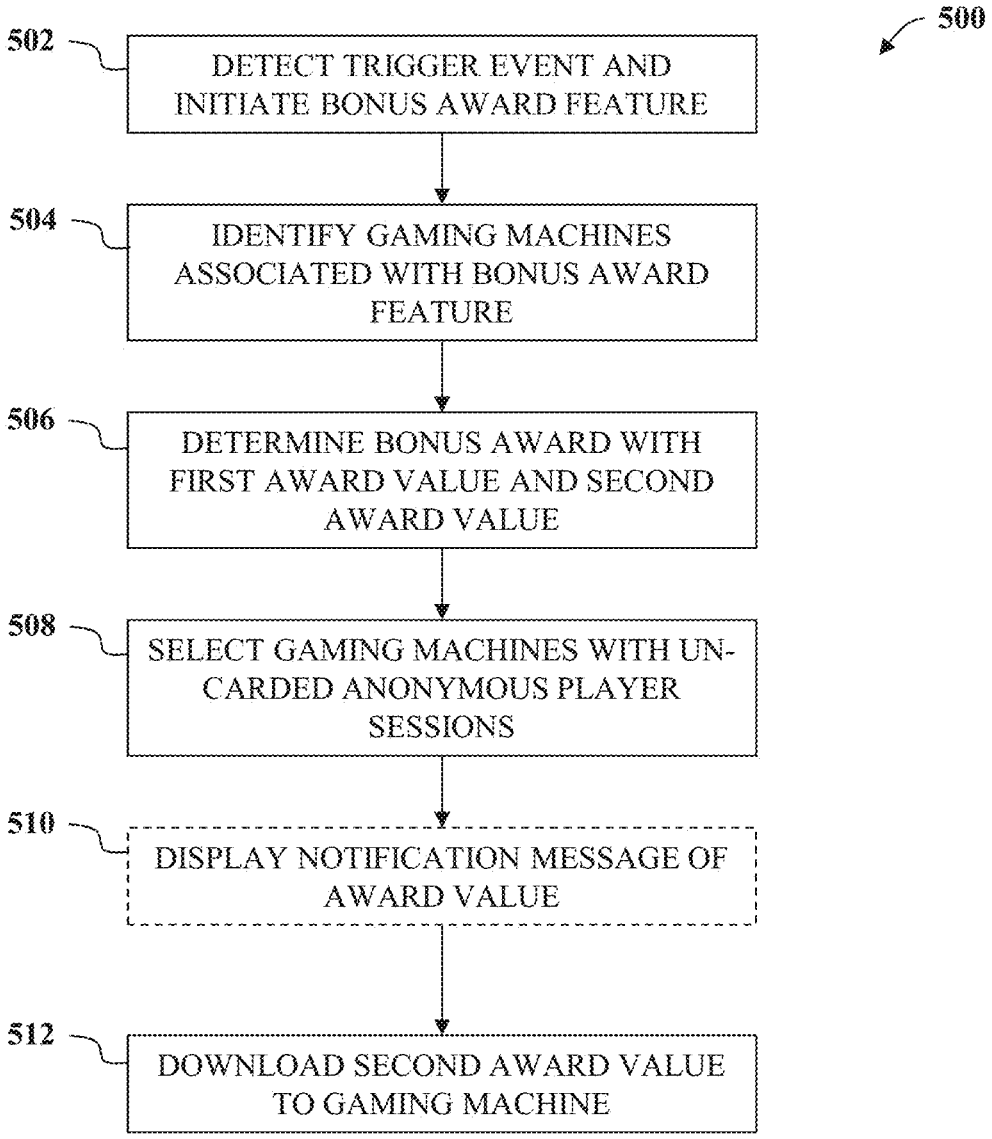
Figure 23:
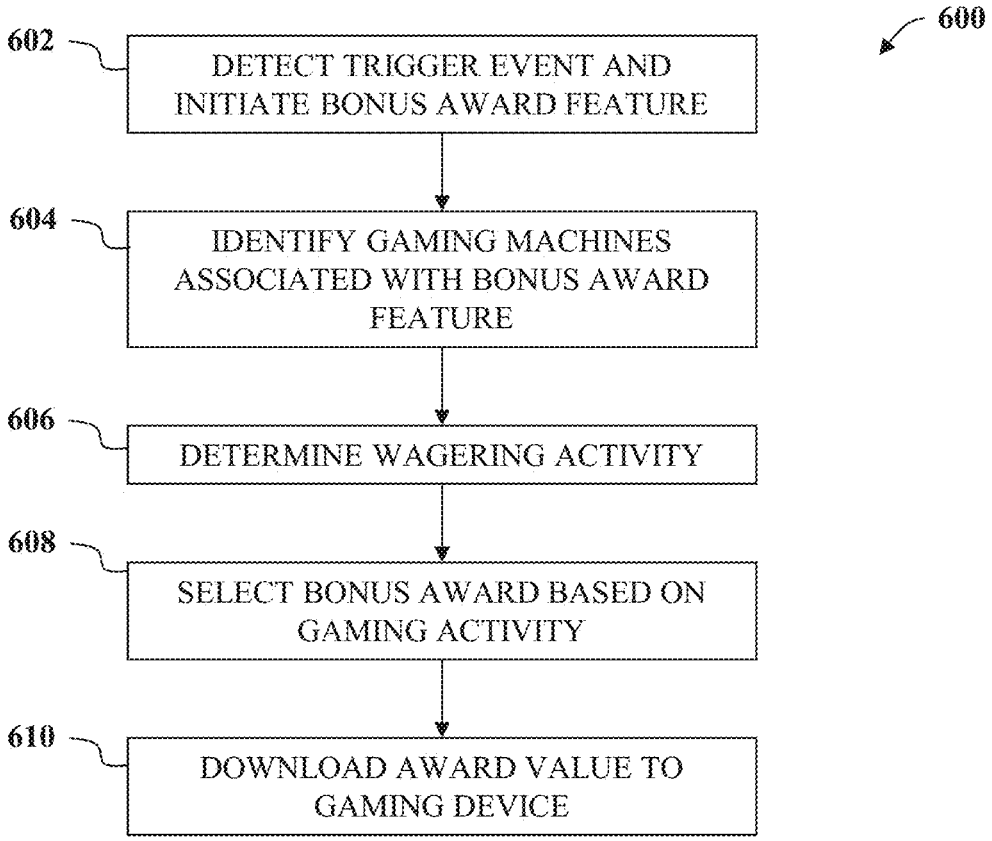
Figure 24:
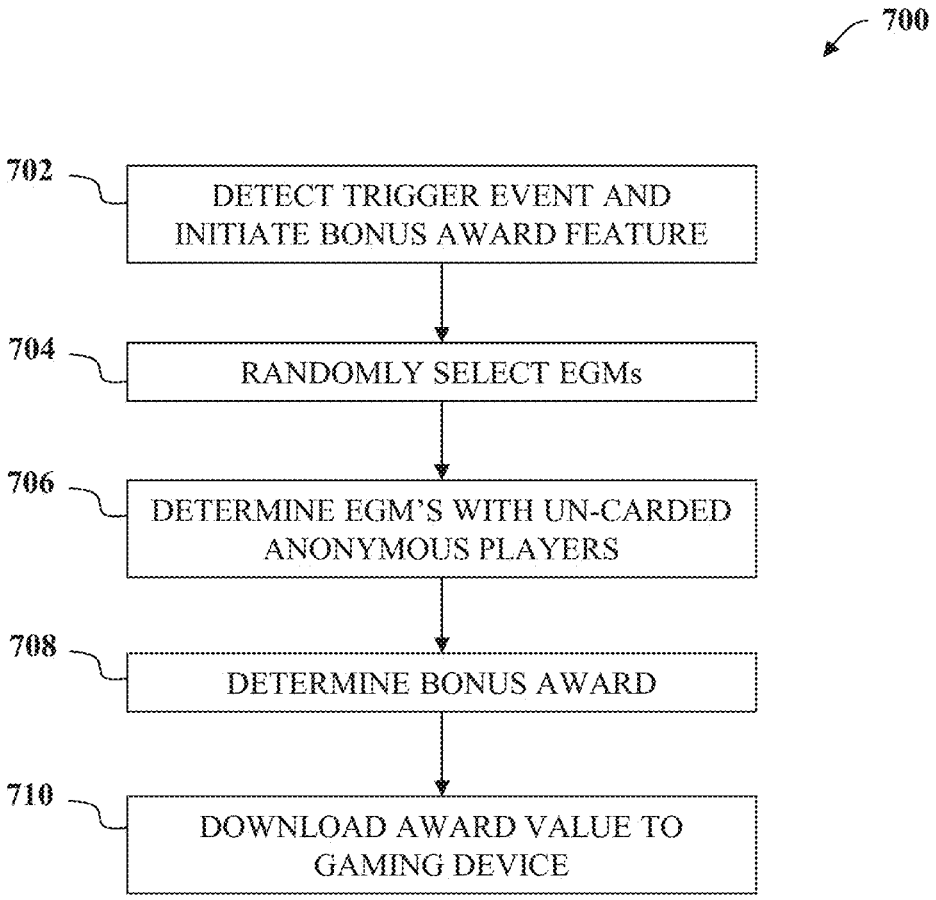
Figure 25:
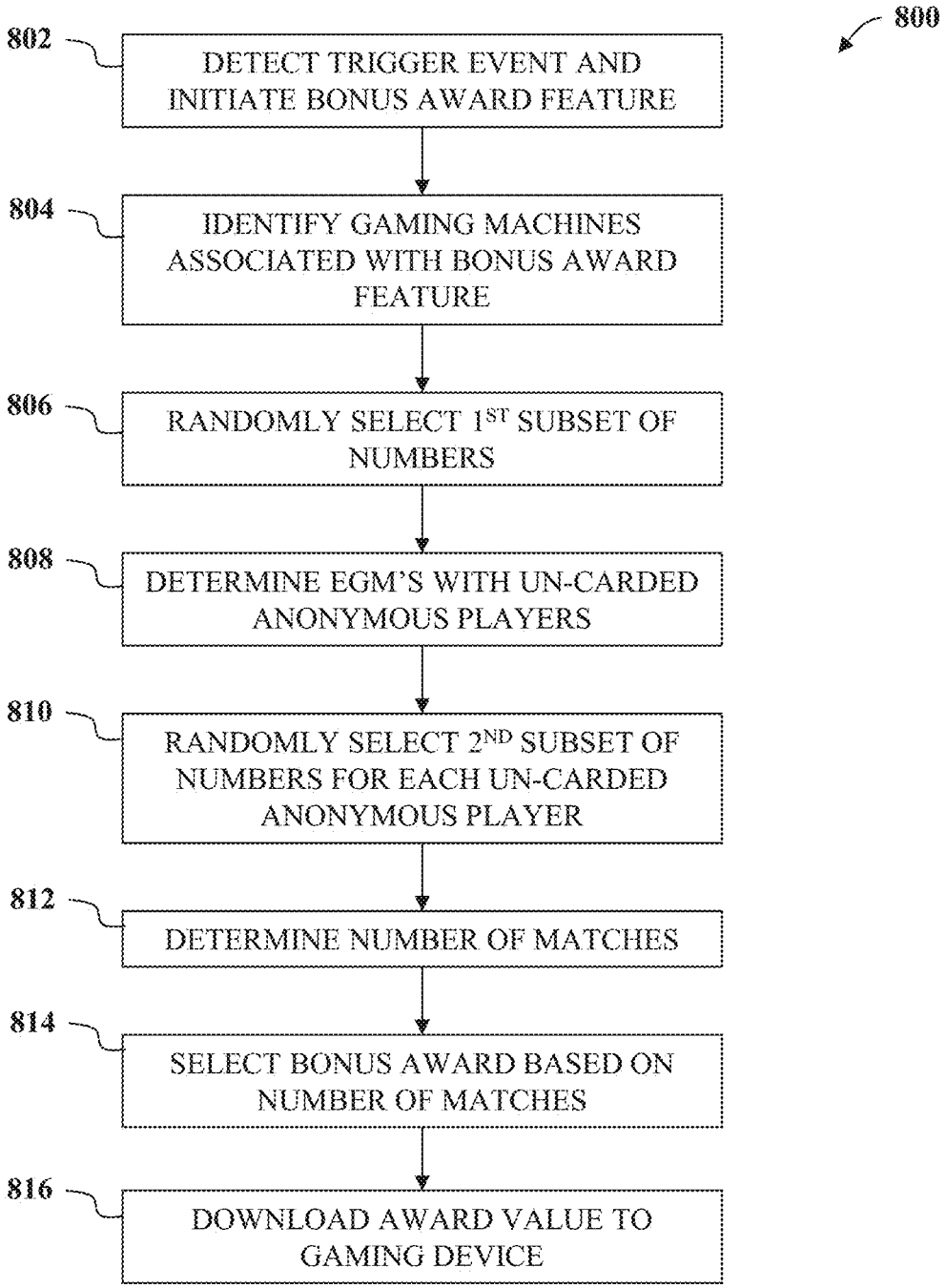

In the illustrated embodiment, the casino management server system 11 implements algorithm methods 500, 600, 700, 800 to initiate a bonus award features using the advanced incentives bonus award table 262, the random bonus award table 264, and/or the match game bonus award table 266. Referring to FIG. 22, in the illustrated embodiment, in method step 502, the casino management server detects a triggering event and initiates the bonus award feature. For example, the casino management server may be programed to detect triggering events stored in each of the bonus award tables 262, 264, 266 and initiate a corresponding bonus award feature upon detecting a corresponding triggering event.

In method step 504, the casino management server identifies the gaming machines associated with the bonus award feature. For example, the casino management server may randomly select gaming machines with active gaming sessions, randomly select a subset of gaming machines with active gaming sessions, identify gaming machines with current gaming sessions meeting predefined wagering activity, and/or select predefined zones of gaming machines.

In method step 506, the casino management server determines a bonus award associated with the bonus award feature. For example, the casino management server may access a corresponding bonus award table 262, 264, 266 and select a bonus award associated with the initiated bonus award feature. The selected bonus award includes a first award value associated with a carded player account and a second award value associated with an un-carded anonymous player wagering session and/or account.

In method step 508, the casino management server selects gaming machines having gaming sessions associated with un-carded anonymous player wagering sessions and/or accounts 250.

In method step 510, the casino management server displays a bonus award notification image on each selected gaming machines that has gaming sessions associated with un-carded anonymous player wagering session and/or accounts 250. The bonus award image includes a message notifying the player of the first award value associated with a carded player account and the second award value associated with an un-carded anonymous player wagering session and/or account. For example, as shown in FIG. 32, upon identifying gaming machines being played by un-carded anonymous players, and selecting the bonus awards, the casino management server displays the bonus award notification image 284 on the gaming machine 28 including the message indicating the award of the second award value 272 and the potential award of the first award value 270 to notify the anonymous player of the potential first award value that is being provided to carded players. In one embodiment, the casino management server may display the bonus award notification image 284 on the non-gaming content section 70 of the player interaction screen 66 (shown in FIG. 32) or display the bonus award notification image 284 on the display of the player tracking terminal device 94. In one embodiment, the casino management server does not display the bonus award notification image and proceeds from method step 508 to method step 512.

In method step 512, the casino management server downloads the second award value to a corresponding gaming credit meter of each selected gaming machine associated with un-carded anonymous player wagering sessions and/or accounts. For example, the second award value may include cashable gaming credits that are downloaded to the corresponding gaming machine 28 for use by the player in placing wagers on games being displayed by the gaming machine.

In one embodiment, the casino management server may be programmed to implement method 600 to implement the bonus award feature using the advanced incentives bonus award table 262. For example, in method step 602, the casino management server accesses the advanced incentives bonus award table 262 to determine triggering events associated with the advanced incentives bonus award table 262, detects a triggering event, and responsively initiates the bonus award feature. For example, the advanced incentives bonus award table 262 may include triggering events including a predefined time of day and/or predefined wagering activity.

In method step 604, the casino management server identifies gaming machines that have active gaming sessions and/or gaming session having wagering activity associated with the triggering condition. In method step 606, the casino management server determines the wagering activity associated with each identified gaming machine. In methods step 608, the casino management server accesses the advanced incentives bonus award table 262 and selects the bonus award associated with the determined wagering activity associated with each gaming machine.

In one embodiment, the casino management server monitors wagering activity associated with the detected gaming session, and initiates the bonus award feature upon determining the monitored wagering activity matches a predefined wagering activity.

In method step 610, the casino management server identifies each gaming device associated with an un-carded anonymous player wagering session and/or account and downloads the second award value to a corresponding gaming credit meter. In one embodiment, the casino management server displays the bonus award notification image 284 on the gaming device including the message indicating the award of the second award value 272 and the potential award of the first award value 270.

The casino management server may also be programmed to implement method 700 to implement the bonus award feature using the random bonus award table 264. For example, in method step 702, the casino management server may access the random bonus award table 264 to determine triggering events associated with the bonus award feature, detect a triggering event associated with the a bonus award, and responsively initiate the bonus award feature.

In method step 704, the casino management server randomly selects one or more gaming machines from the plurality of gaming machines based on the triggering event.

In method step 706, the casino management server determines each randomly selected gaming machine having gaming sessions associated with un-carded anonymous player wagering sessions and/or accounts.

In method step 708, the casino management server determines a wagering level associated with a current gaming session, accesses the random bonus award table 264 including a plurality of bonus awards associated with a plurality of wagering levels, and selects the bonus award associated with the bonus award feature based on the determined wagering level associated with a current gaming session.

In method step 710, the casino management server identifies each gaming machine associated with an un-carded anonymous player wagering session and/or account and downloads the second award value to a corresponding gaming credit meter. In one embodiment, the casino management server displays the bonus award notification image 284 on the gaming machine 28 including the message indicating the award of the second award value 272 and the potential award of the first award value 270.

The casino management server may also be programmed to implement method 800 to implement the bonus award feature using the match game bonus award table 266. For example, in method step 802, the casino management server detects predefined triggering condition stored in the match game bonus award table 266 and responsively initiate the bonus award feature including a matching game 286 (shown in FIG. 32).

In method steps 804 and 806, the casino management server identifies gaming machines associated with the bonus award feature and randomly selects a first subset of numeric symbols 288 (shown in FIG. 32) from a predefined set of numeric symbols.

In method steps 808 and 810, the casino management server identifies each gaming machine associated with an un-carded anonymous player wagering sessions and/or accounts 250, and randomly select a second subset of numeric symbols 290 (shown in FIG. 32) from the predefined set of numeric symbols for each un-carded anonymous player wagering session and/or account associated with a selected identified gaming machine.

In method step 812, the casino management server compares the first subset of numeric symbols 288 with the second subset of numeric symbols 290, and determines a number of matching numeric symbols between the first subset of numeric symbols and the second subset of numeric symbols.

In method step 814, the casino management server accesses the match game bonus award table 266 that includes a plurality of bonus awards associated with a plurality of numbers of matching numeric symbols, and selects the bonus award associated with the bonus award feature based on the determined number of matching numeric symbols.

In method step 816, for each identified gaming machine associated with an un-carded anonymous player wagering sessions and/or accounts 250, the casino management server downloads the second award value to a corresponding gaming credit meter. In one embodiment, the casino management server displays the bonus award notification image 284 on the gaming machine 28 including the message indicating the award of the second award value 272 and the potential award of the first award value 270.

Obviously, many modifications and variations of the present invention are possible in light of the above teachings. The invention may be practiced otherwise than as specifically described within the scope of the appended claims.

Exemplary embodiments of a system and method for providing gaming property services to a patron are described above in detail. The system and method are not limited to the specific embodiments described herein, but rather, components of the system and/or steps of the method may be utilized independently and separately from other components and/or steps described herein. For example, the system may also be used in combination with other wagering systems and methods, and is not limited to practice with only the system as described herein. Rather, an exemplary embodiment can be implemented and utilized in connection with many other monitoring applications.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor. Processors may execute one or more program applications, such as a web browser (e.g., Microsoft Internet Explorer, Mozilla Firefox, Apple Safari, Google Chrome, and Opera, etc.), to access and view content over a computer network. In particular implementations, the program applications allow a user to enter addresses of specific network resources to be retrieved, such as resources hosted by a networking system. These addresses can be Uniform Resource Locators, or URLs. In addition, once a page or other resource has been retrieved, the client applications may provide access to other pages or records when the user "clicks" on hyperlinks to other resources. By way of example, such hyperlinks may be located within the webpages and provide an automated way for the user to enter the URL of another page and to retrieve that page. A webpage or resource embedded within a webpage, which may itself include multiple embedded resources, may include data records, such as plain textual information, or more complex digitally encoded multimedia content, such as software programs or other code objects, graphics, images, audio signals, videos, and so forth. One prevalent markup language for creating webpages is the Hypertext Markup Language (HTML). Other common web browser-supported languages and technologies include the Extensible Markup Language (XML), the Extensible Hypertext Markup Language (XHTML), JavaScript, Flash, ActionScript, Cascading Style Sheet (CSS), and, frequently, Java.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DBx, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

In some embodiments, a network, as described herein, includes a network addressable system that, in various example embodiments, comprises one or more physical servers and data stores. The one or more physical servers are operably connected to a computer network via, by way of example, a set of routers and/or networking switches. In an example embodiment, the functionality hosted by the one or more physical servers may include web or HTTP servers, FTP servers, as well as, without limitation, webpages and applications implemented using Common Gateway Interface (CGI) script, PHP Hyper-text Preprocessor (PHP), Active Server Pages (ASP), Hyper Text Markup Language (HTML), Extensible Markup Language (XML), Java, JavaScript, Asynchronous JavaScript and XML (AJAX), Flash, ActionScript, and the like. Data stores may store content and data relating to, and enabling, operation of the networking system as digital data objects. A data object, in particular implementations, is an item of digital information typically stored or embodied in a data file, database or record. Content objects may take many forms, including: text (e.g., ASCII, SGML, HTML), images (e.g., jpcg, tif and gif), graphics (vector-based or bitmap), audio, video (e.g., mpeg), or other multimedia, and combinations thereof. Content object data may also include executable code objects (e.g., games executable within a browser window or frame), podcasts, etc. Data stores corresponds to one or more of a variety of separate and integrated databases, such as relational databases and object-oriented databases, that maintain information as an integrated collection of logically related records or files stored on one or more physical systems.

For example, the processes described herein may be implemented using hardware components, software components, and/or any combination thereof. By way of example, while embodiments of the present disclosure have been described as operating in connection with a networking web site, various embodiments of the present invention can be used in connection with any communications facility that supports web applications. Furthermore, in some embodiments the term "web service" and "website" may be used interchangeably and additionally may refer to a custom or generalized API on a device, such as a mobile device (e.g., cellular phone, smart phone, personal GPS, personal digital assistance, personal gaming device, etc.), that makes API calls directly to a server. The specification and drawings are, accordingly, to be regarded in an illustrative rather than a restrictive sense. It will, however, be evident that various modifications and changes may be made thereunto without departing from the broader spirit and scope of the invention as set forth in the claims and that the invention is intended to cover all modifications and equivalents within the scope of the following claims This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the present invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A gaming system, comprising:

a plurality of gaming machines, each gaming machine including a display device and a gaming controller configured to display a game to a player via the display device and establish a gaming credit meter for use in placing wagers on the game by the player; and a casino management server coupled to each of the plurality of gaming machines, the casino management server including a processor for implementing a bonus award feature, the processor programmed to execute an algorithm including:

initiate the bonus award feature by randomly selecting one or more gaming machines from the plurality of gaming machines and identify gaming machines associated with the bonus award feature;

select gaming machines having gaming sessions associated with un-carded anonymous player wagering sessions; and;

for each randomly selected gaming machine having gaming sessions associated with un-carded anonymous player wagering sessions:

determine a wagering level associated with a current gaming session;

access a bonus awards table stored in a memory device, the bonus awards table including a plurality of bonus awards associated with a plurality of wagering levels;

select a bonus award associated with the bonus award feature based on the determined wagering level associated with a current gaming session, the bonus award including a first award value associated with a carded player account and a second award value associated with an un-carded anonymous player wagering session, the first award value being greater than the second award value; and display, on each selected gaming machine, a message notifying the player of the first award value and the second award value associated with the selected bonus award; and download the second award value to a corresponding gaming credit meter of each selected gaming machine associated with un-carded anonymous player wagering session.

2. The gaming system of claim 1, wherein the casino management server includes a memory device storing a plurality of carded player accounts and a plurality of un-carded anonymous player accounts associated with un-carded anonymous player wagering sessions;

wherein each carded player account and un-carded anonymous player account includes an account ID; and wherein each carded player account including a corresponding unique patron card ID and each un-carded anonymous player account does not include a corresponding unique patron card ID.

3. The gaming system of claim 1, wherein the processor of the casino management server is further programmed to:

detect a gaming session being initiated by a corresponding player at a corresponding gaming machine;

determine whether a carded player account is associated with the player; and generate a corresponding un-carded anonymous player wagering session associated with the gaming session upon determining a carded player account is not associated with the corresponding player;

wherein the corresponding un-carded anonymous player wagering session includes a gaming machine ID associated with the corresponding gaming machine, a unique gaming session ID, and wagering information associated with the detected gaming session.

4. The gaming system of claim 3, wherein the processor of the casino management server is further programmed to:

monitor wagering activity associated with the detected gaming session; and initiate the bonus award feature upon determining the monitored wagering activity matches a pre-defined wagering activity.

5. The gaming system of claim 3, wherein the processor of the casino management server is further programmed to:

receive a video image of the player from a video image sensor associated with the corresponding gaming machine; and generate a corresponding un-carded anonymous player account including data associated with the video image of the player.

6. The gaming system of claim 5, wherein the processor of the casino management server is further programmed to:

detect a subsequent gaming session being initiated by the player;

receive video images of the player from the corresponding gaming machine;

identify the corresponding un-carded anonymous player account based on the received receive video images of the player; and modify the identified un-carded anonymous player account to include information associated with the subsequent gaming session.

7. The gaming system of claim 3, further comprising a plurality of player tracking devices coupled to each of the gaming machines;

wherein the processor of the casino management server is further programmed to:

detect the gaming session being initiated by the corresponding player at the corresponding gaming machine and receive a patron card ID from a player tracking device associated with the corresponding gaming machine; and identify a corresponding carded player account associated with the corresponding player based on the received patron card ID.

8. A gaming system comprising:

a plurality of gaming machines, each gaming machine including a display device and a gaming controller configured to display a game to a player via the display device and establish a gaming credit meter for use in placing wagers on the game by the player; and a casino management server coupled to each of the plurality of gaming machines, the casino management server including a processor for implementing a bonus award feature, the processor programmed to execute an algorithm including:

initiate the bonus award feature by identifying gaming machines associated with the bonus award feature and randomly selecting a first subset of numeric symbols from a predefined set of numeric symbols;

selecting gaming machines having gaming sessions associated with un-carded anonymous player wagering sessions; and for each un-carded anonymous player wagering session associated with a selected identified gaming machine:

randomly select a second subset of numeric symbols from the predefined set of numeric symbols;

compare the first subset of numeric symbols with the second subset of numeric symbols, and determine a number of matching numeric symbols between the first subset of numeric symbols and the second subset of numeric symbols;

access a bonus awards table stored in a memory device, the bonus awards table including a plurality of bonus awards associated with a plurality of numbers of matching numeric symbols;

select the bonus award associated with the bonus award feature based on the determined number of matching numeric symbols, the bonus award including a first award value associated with a carded player account and a second award value associated with an un-carded anonymous player wagering session, the first award value being greater than the second award value; and display an award message notifying the player of the first award value and the second award value associated with the selected bonus award and download the second award value to the corresponding gaming credit meter.

9. A casino management server for use in gaming system including a plurality of gaming machines, each gaming machine including a display device and a gaming controller configured to display a game to a player via the display device and establish a gaming credit meter for use in placing wagers on the game by the player, the casino management server comprising:

a memory device configured to store a plurality of carded player accounts and a plurality of un-carded anonymous player wagering sessions; and a processor coupled to the plurality of gaming machines for implementing a bonus award feature, the processor programmed to execute an algorithm including:

initiate a bonus award feature by randomly selecting one or more gaming machines from the plurality of gaming machines and identify gaming machines associated with the bonus award feature;

select gaming machines having gaming sessions associated with un-carded anonymous player wagering sessions; and;

for each randomly selected gaming machine having gaming sessions associated with un-carded anonymous player wagering sessions:

determine a wagering level associated with a current gaming session;

access a bonus awards table stored in a memory device, the bonus awards table including a plurality of bonus awards associated with a plurality of wagering levels;

determine a bonus award associated with the bonus award feature based on the determined wagering level associated with a current gaming session, the bonus award including a first award value associated with a carded player account and a second award value associated with a un-carded anonymous player wagering session, the first award value being greater than the second award value;

display, on each selected gaming machine, a message notifying the player of the first award value associated with the carded player account and the second award value associated with the un-carded anonymous player wagering session; and download the second award value to a corresponding gaming credit meter of each selected gaming machine associated with un-carded anonymous player wagering session.

10. The casino management server of claim 9, wherein each carded player account and un-carded anonymous player wagering session includes an account ID; and wherein each carded player account including a corresponding unique patron card ID and each un-carded anonymous player wagering session does not include a corresponding unique patron card ID.

11. The casino management server of claim 9, wherein the processor is further programmed to:

detect a gaming session being initiated by a corresponding player at a corresponding gaming machine;

determine whether a carded player account is associated with the player; and generate a corresponding un-carded anonymous player wagering session associated with the gaming session upon determining a carded player account is not associated with the corresponding player;

wherein the corresponding un-carded anonymous player wagering session includes a gaming machine ID associated with the corresponding gaming machine, a unique gaming session ID, and wagering information associated with the detected gaming session.

12. The casino management server of claim 11, wherein the processor is further programmed to:

monitor wagering activity associated with the detected gaming session; and initiate the bonus award feature upon determining the monitored wagering activity matches a pre-defined wagering activity.

13. The casino management server of claim 11, wherein the processor is further programmed to:

receive a video image of the player from a video image sensor associated with the corresponding gaming machine; and generate a corresponding un-carded anonymous player account including data associated with the video image of the player.

14. The casino management server of claim 13, wherein the processor is further programmed to:

detect a subsequent gaming session being initiated by the player;

receive video images of the player from the corresponding gaming machine;

identify the corresponding un-carded anonymous player account based on the received receive video images of the player; and modify the identified un-carded anonymous player account to include information associated with the subsequent gaming session.

15. The casino management server of claim 11, further comprising a plurality of player tracking devices coupled to each of the gaming machines;

wherein the processor is further programmed to:

detect the gaming session being initiated by the corresponding player at the corresponding gaming machine and receive a patron card ID from a player tracking device associated with the corresponding gaming machine; and identify a corresponding carded player account associated with the corresponding player based on the received patron card ID.

16. A casino management server for use in gaming system including a plurality of gaming machines, each gaming machine including a display device and a gaming controller configured to display a game to a player via the display device and establish a gaming credit meter for use in placing wagers on the game by the player, the casino management server comprising:

a memory device configured to store a plurality of carded player accounts and a plurality of un-carded anonymous player wagering sessions; and a processor coupled to the plurality of gaming machines for implementing a bonus award feature, the processor programmed to execute an algorithm including:

initiate the bonus award feature by identifying gaming machines associated with the bonus award feature and randomly selecting a first subset of numeric symbols from a predefined set of numeric symbols;

selecting gaming machines having gaming sessions associated with un-carded anonymous player wagering sessions; and for each un-carded anonymous player wagering session associated with a selected identified gaming machine:

randomly select a second subset of numeric symbols from the predefined set of numeric symbols;

compare the first subset of numeric symbols with the second subset of numeric symbols, and determine a number of matching numeric symbols between the first subset of numeric symbols and the second subset of numeric symbols;

access a bonus awards table stored in a memory device, the bonus awards table including a plurality of bonus awards associated with a plurality of numbers of matching numeric symbols;

select the bonus award associated with the bonus award feature based on the determined number of matching numeric symbols, the bonus award including a first award value associated with a carded player account and a second award value associated with an un-carded anonymous player wagering session, the first award value being greater than the second award value; and display an award message notifying the player of the first award value and the second award value associated with the selected bonus award and download the second award value to the corresponding gaming credit meter.

17. A non-transitory computer-readable storage medium storing computer-executable instructions, which when executed by a processor, cause the processor to implement a bonus award feature by performing the algorithm steps of:

initiating the bonus award feature by randomly selecting one or more gaming machines from the plurality of gaming machines and identify gaming machines associated with the bonus award feature;

selecting gaming machines having gaming sessions associated with un-carded anonymous player wagering sessions; and;

for each randomly selected gaming machine having gaming sessions associated with un-carded anonymous player wagering sessions:

determining a wagering level associated with a current gaming session;

accessing a bonus awards table stored in a memory device, the bonus awards table including a plurality of bonus awards associated with a plurality of wagering levels;

determining a bonus award associated with the bonus award feature based on the determined wagering level associated with a current gaming session, the bonus award including a first award value associated with a carded player account and a second award value associated with an un-carded anonymous player wagering session, the first award value being greater than the second award value;

displaying, on each selected gaming machine, a message notifying the player of the first award value associated with the carded player account and the second award value associated with the un-carded anonymous player wagering session; and downloading the second award value to a corresponding gaming credit meter of each selected gaming machine associated with un-carded anonymous player wagering sessions.

* * * * *